US005913320A

United States Patent [19]

Varrin, Jr. et al.

[11] Patent Number: 5,913,320

[45] Date of Patent: Jun. 22, 1999

[54] SLUDGE REMOVAL SYSTEM

[75] Inventors: Robert D. Varrin, Jr., McLean; Michael J. Marohnic, Warrenton; Marc A. Kreider, Falls Church; Arthur P. L. Turner, Burke, all of Va.; Said Lounis, Bloomfield, Mich.

[73] Assignee: Foster-Miller, Inc., Waltham, Mass.

[21] Appl. No.: 08/419,942

[22] Filed: Apr. 11, 1995

[51] Int. Cl.[6] ..... B08B 3/02

[52] U.S. Cl. ..... 134/22.18; 134/24; 134/181; 134/167 R; 122/392

[58] Field of Search ..... 134/167 R, 168 R, 134/180, 181, 172, 176, 179, 21.1, 22.18, 24; 122/392

[56] References Cited

U.S. PATENT DOCUMENTS

| | | | |
|---|---|---|---|
| H1115 | 12/1992 | Nachbar . | |
| 2,497,171 | 2/1950 | Jones et al. . | |
| 3,358,935 | 12/1967 | Andersen | 134/167 R |
| 3,487,841 | 1/1970 | Goodrum | 134/167 R |
| 3,542,593 | 11/1970 | Pribbernow | 134/167 R |
| 3,625,234 | 12/1971 | Baldwin | 134/167 R |
| 3,880,359 | 4/1975 | Novy | 134/168 R |
| 4,071,919 | 2/1978 | Fields et al. . | |
| 4,196,049 | 4/1980 | Burns et al. . | |
| 4,219,976 | 9/1980 | Burack et al. | 134/167 R |
| 4,302,772 | 11/1981 | Gillot . | |
| 4,311,556 | 1/1982 | Iwamoto et al. . | |
| 4,393,920 | 7/1983 | Shima et al. . | |
| 4,424,769 | 1/1984 | Charamathieu et al. . | |
| 4,470,952 | 9/1984 | Vassalotti . | |
| 4,496,519 | 1/1985 | McGuire | 134/168 R |
| 4,505,874 | 3/1985 | Warren et al. . | |
| 4,676,201 | 6/1987 | Lahoda et al. . | |
| 4,696,612 | 9/1987 | Germond et al. . | |
| 4,700,662 | 10/1987 | Fasnacht et al. . | |
| 4,757,785 | 7/1988 | Klahn et al. . | |
| 4,760,876 | 8/1988 | Minogue . | |
| 4,805,650 | 2/1989 | Yasui et al. . | |
| 4,827,878 | 5/1989 | Stewart . | |
| 4,827,953 | 5/1989 | Lee . | |
| 4,828,651 | 5/1989 | Lumbroso et al. . | |
| 4,899,697 | 2/1990 | Franklin et al. . | |
| 4,980,120 | 12/1990 | Bowman et al. . | |
| 5,006,304 | 4/1991 | Franklin et al. . | |
| 5,019,329 | 5/1991 | Franklin et al. . | |
| 5,036,871 | 8/1991 | Ruggieri et al. . | |
| 5,065,703 | 11/1991 | Lee . | |
| 5,069,172 | 12/1991 | Shirey et al. . | |
| 5,076,893 | 12/1991 | Tong et al. . | |
| 5,104,611 | 4/1992 | Woods et al. . | |
| 5,107,873 | 4/1992 | Clinger | 134/167 R |
| 5,194,217 | 3/1993 | St. Louis et al. . | |
| 5,265,129 | 11/1993 | Brooks et al. . | |
| 5,352,298 | 10/1994 | Moulder | 134/168 R |
| 5,411,043 | 5/1995 | Kamler | 134/167 R |
| 5,518,553 | 5/1996 | Moulder | 134/167 R |

OTHER PUBLICATIONS

A.T. Ashton & John Gay, "SID seeks sludge & foreign bodies in steam generator upper heads while . . . ", Nuclear Engineering International, ROBOTICS & MAINTENANCE, Mar. 1993, pp. 20–22 & p. 24.

Explore Unchanted Territory, Nuclear Engineer International, Oct. 1993.

*Primary Examiner*—Frankie L. Stinson

*Attorney, Agent, or Firm*—Pillsbury Madison & Sutro LLP

[57] ABSTRACT

An improved remotely-operated high-pressure water-jet sludge lancing system for removing sludge from the secondary side of steam generators, the system including an end effector and a deployment system. The end effector includes two diametrically opposed articulated nozzle heads having water jet nozzles attached thereto. The nozzle heads are pivotally mounted to respective pneumatic extension arm actuators that are accommodated in respective arms. The arms are attached in a collinear relation to opposing sides of a centrally located drive means, which allows for the rotational positioning of the nozzle heads. The deployment system for delivering and supporting the end effector includes a self-erecting load-bearing chain and a segmented support rail having a straight section and a curved section. The chain is suspended from the support rail by hangers and cylinder rollers.

38 Claims, 11 Drawing Sheets

SLUDGE REMOVAL SYSTEM

BACKGROUND OF THE INVENTION

1. Field of Invention

The present invention relates generally to a method and apparatus for removing sludge deposits from the secondary side of nuclear steam generator systems. More particularly, the present invention provides a remotely-operated high-pressure water-jet sludge removal system for pressurized-water reactor steam generators.

2. Description of Related Art

In nuclear power plants, nuclear steam generators serve as large heat-exchangers for generating steam which is used for driving turbines. A typical nuclear steam generator has a vertically oriented outer shell containing a plurality of inverted U-shaped heat-exchanger tubes disposed therein to collectively form a tube bundle. The U-shaped tubes are arranged in a triangular-pitch or square-pitch tube array to form interstitial gaps and intertube lanes that are approximately 1/10 to 4/10 inch wide. In some designs, a centrally located, untubed region extending longitudinally along the central vertical axis of the heat exchanger is defined by the elongated portions of the innermost U-shaped tubes.

A plurality of horizontally oriented upper annular support plates, or in some designs "eggcrate" supports, are provided at periodic intervals for arranging and supporting the U-shaped tubes. Each support plate or eggcrate support contains a triangular- or square-pitch array of holes or openings therein for accommodating the elongated portions of the U-shaped tubes. The upper support plates or eggcrate supports are positioned in relation to one another so that the holes thereof are aligned, thereby allowing the elongated portions of the U-shaped tubes to be accommodated within the holes. The height of the U-shaped tubes may exceed thirty-two feet. A steam generator typically includes six to eight or more support plates and/or eggcrate supports, each horizontally disposed and vertically separated at three- to five-foot intervals. Additionally, tie rods and wrappers may be used for providing further support to the U-shaped tubes by supporting the annular support plates and/or eggcrate supports.

A tubesheet spaced below the lowermost eggcrate support separates a lower primary side from an upper secondary side of the steam generator. A dividing plate cooperates with the lower face of the tubesheet to divide the primary side into an entrance plenum for accepting hot primary coolant from a nuclear core and an exit plenum for recycling lower temperature primary coolant to the reactor for reheating. The entrance and exit plenums are connected by the U-shaped tubes. Primary fluid that is heated by circulation through the core of the nuclear reactor enters the steam generator through the entrance plenum. The primary fluid is fed into the U-shaped tubes, which carry the primary fluid through the secondary side of the steam generator. A secondary fluid, generally water, is concurrently introduced into the secondary side of the steam generator and circulated through the interstitial gaps between the U-shaped tubes. Although isolated from the primary fluid in the U-shaped tubes, the secondary fluid comes into fluid communication with the peripheral surfaces of the U-shaped tubes. Heat is consequently transferred from the primary fluid to the secondary fluid, which, in turn, converts the secondary fluid into steam that is removed from the top of the steam generator in a continuous steam generation cycle. The steam is subsequently circulated through standard electrical generating equipment. The cooled primary fluid exits the steam generator through the exit plenum, where it is returned to the nuclear reactor for reheating.

The secondary fluid entering the steam generator often includes undesirable impurities or chemicals. The principal impurities are iron, copper, and hardness species such as calcium and magnesium. Due to the constant high temperature and severe operating environment, these impurities are left behind in the steam generator and manifest themselves in the form of a corrosive sludge mainly comprised of iron oxides, copper oxides, copper metal, and insoluble hardness species. The sludge accumulates on the outer peripheral surfaces of the U-shaped tubes, the support plates, the lower eggcrate supports, and within the interstitial gaps formed by the tubes and the tube supports. It is not uncommon for thousands of pounds of sludge to accumulate after only several years of plant operation. Tube surface deposits account for approximately 80 to 85 percent of the sludge in a typical steam generator. As the sludge accumulation on the tube bundle and the tube supports increases, the heat transfer efficiency of the steam generator correspondingly decreases. Moreover, corrosion of the heat exchanger U-shaped tubes and potential stress corrosion cracking in the U-shaped tubes raises concerns over leakage of radioactive primary fluid and resulting contamination of the secondary fluid.

Thus, periodic removal of the sludge from the steam generator is an important step towards maximizing the heat transfer efficiency of the steam generator and alleviating concerns over corrosion. To remove the sludge, several cleaning apparatuses and methods have been proposed. Examples of prior art cleaning methods include chemical cleaning, pressure pulse cleaning, and sludge lancing. Chemical and pressure pulse cleaning are considered unfavorable because their costs tend to be excessive. In addition, chemical cleaning can advance the corrosion of the steam generator structure and pressure pulse cleaning is only marginally effective for removing deposits.

Conventional sludge lancing involves directing a high-powered jet (about 1500 to 15,000 pounds per square inch (psi)) of pressurized water at sludge located on the tubesheet, where approximately 15 percent of the sludge is located. In many nuclear steam generators in service today, there are two- to six-inch diameter hand holes located in the outer shell about the periphery of the tubesheet that provide access to the secondary side of the steam generators at the tubesheet elevation. The hand holes provide access to an untubed corridor, also known as a blowdown lane, that extends along a diameter of the steam generator and in some designs passes through a central untubed portion thereof. The untubed corridor is approximately four inches wide. Vertically oriented tie rods often bisect the untubed corridor, dividing it in two unencumbered free lanes having respective widths less than approximately 1¾ inches. Conventional sludge lancing systems are introduced into the steam generator through the hand holes, thereby allowing for water jet nozzles to be positioned along the blowdown lane. The sludge lancing jets are moved along the blowdown lane and aligned with the gaps formed by the tube array. Pressurized water discharged from the lancing jets impinges upon the sludge deposits to loosen them. Once dislodged by the water jets, the tubesheet sludge deposits are collected by a suction system. In other conventional tubesheet sludge lancing designs, a mobile system is deployed at the periphery of the tube bundle, and water jets are directed from the tube bundle periphery radially inward toward the center of the bundle. The disadvantage of these conventional sludge lancing systems is that they can only target sludge deposits at the lowest region of the steam generator. The majority of the deposits located on the secondary side are not accessible, since hand holes typically are not present in the upper portion of the outer shell.

Attempts to provide a system that may be introduced through a lower hand hole for cleaning the upper portion of the secondary side have heretofore proven to be ineffective or infeasible. For example, U.S. Pat. No. 5,265,129 issued to Brooks et al. discloses a support plate inspection device (SID) that includes a horizontal boom that extends along a blowdown lane, a vertical telescoping member attached to the distal end of the horizontal boom that extends upwardly into the secondary side of a steam generator, and a cleaning nozzle and video camera attached to the upper distal end of the vertical member. However, those skilled in the design of remotely operated robotic systems would conclude that the SID system may not be able to display a high load-bearing capability and could become inherently unstable as a result of a variety of torques, loads, and moments placed on the telescoping member. That is, when the vertical member is arranged in its extended position, it is susceptible to flexure, buckling, and bending caused by any eccentricity of the load thereon or by reaction forces imparted on the system by the water jet discharged from the attached cleaning nozzle. The inadequacy of a telescoping design is related to the need to use thin-walled tubing to form a suitably small set of nested cylinders (e.g., the collapsed system must exhibit an overall diameter of less than 2 to 3 inches). As a result, the SID system can damage the tube bundle or even become permanently lodged within the steam generator. In addition, the SID system requires a sufficient amount of clearance between the tubesheet and the next highest support member for rotational up-ending so as to place it in a configuration suitable for vertical extension. Only some steam generator designs exhibit sufficient spatial dimension to permit this movement.

SUMMARY OF THE INVENTION

The present invention solves the aforementioned problems associated with the prior art as well as other problems by providing a system for intertube water jetting of the secondary side of a nuclear steam generator.

Accordingly, it is therefore an object of the present invention to provide an improved remotely-operated high-pressure water-jet sludge lancing system for effectively removing sludge from the secondary side of steam generators of the type having a centrally located untubed region defined by a tube bundle, thereby increasing the steam generator efficiency and longevity and minimizing the potential for corrosion.

To accomplish this objective, an embodiment of the present invention provides an end effector and a method for cleaning the secondary side of a steam generator. The end effector includes two diametrically opposed articulated nozzle heads. The nozzle heads are pivotally mounted to corresponding arms and corresponding fluidically-operated extension arm actuators accommodated therein. The arms are positioned in a collinear relationship on opposing sides of a centrally located rotational drive unit. The rotational drive unit and fluidically-operated extension arm actuators combine to allow for the incremental positioning of the nozzle heads at various localities about the periphery of the central untubed region of a steam generator. Each nozzle head preferably contains six water-jet nozzles that are aligned with the 30, 90, and 150 degree intertube gaps formed by the U-shaped tubes in the triangular-pitch tube array. Pressurized water is passed through the water jet nozzles and is discharged into the interstitial gaps between the U-shaped tubes, where the pressurized water collides with and dislodges sludge accumulations. Because the nozzle heads are arranged in diametrically opposing positions, the jet reaction forces generated from the nozzle heads combine to offset one another. A balance is achieved which reduces the forces imparted upon the end effector and the vertical deployment system. This embodiment is particularly suited for those steam generators with a central untubed region, but is also easily adapted for other designs.

It is a further object of the present invention to provide a deployment system and a method for installing the presently disclosed end effector while negotiating the restrictive spatial constraints of a steam generator of the type having a blowdown lane and central untubed region. Features incorporated into the present invention are applicable to other design steam generators.

To accomplish this objective, the present invention provides a deployment system for delivering and supporting the end effector in a manner that both assures accurate positioning of the nozzle jets and assures retrievability of the system in the event of failure. The deployment system includes a self-erecting, high load-bearing chain, a segmented support rail having a curved section at its distal end, and a chain drive mechanism. According to the present deployment system, the end effector is attached to the distal end of the chain so that the longitudinal axes of the chain and end effector are collinear. The chain and end effector are suspended from the support rail by hangers and cylinder rollers. The chain drive mechanism conveys the chain and end effector along a straight rail section of the support rail, which extends through the blowdown lane of a steam generator. The end effector is thereby delivered to the central untubed region. A curved rail section of the support rail disposed in the central untubed region redirects the chain and end effector ninety degrees into a vertically ascending direction. As the chain is further fed into the steam generator, the end effector continues to ascend to a potential elevation of up to the seventh support plate (counting from the bottom). A combination of cable-actuated, pneumatic-cylinder-driven, or hydraulic-cylinder-driven linkages attached to the distal end of the chain are activated to properly and accurately realign the end effector into an operative position once it has reached the central untubed region.

Accordingly, the end effector and deployment system disclosed by the present invention combine to provide a sludge removal system that minimizes the down time of the nuclear steam generator and subjects maintenance personnel to a minimal amount of exposure to a contaminated environment.

These and other objects, features, and advantages of the present invention will become apparent from the following detailed description when taken in conjunction with the accompanying drawings which illustrate, by way of example, the principles of the present invention.

BRIEF DESCRIPTION OF THE DRAWING

The accompanying drawings illustrate the present invention. In such drawings.

DESCRIPTION OF THE PREFERRED EMBODIMENTS

Figure 1:
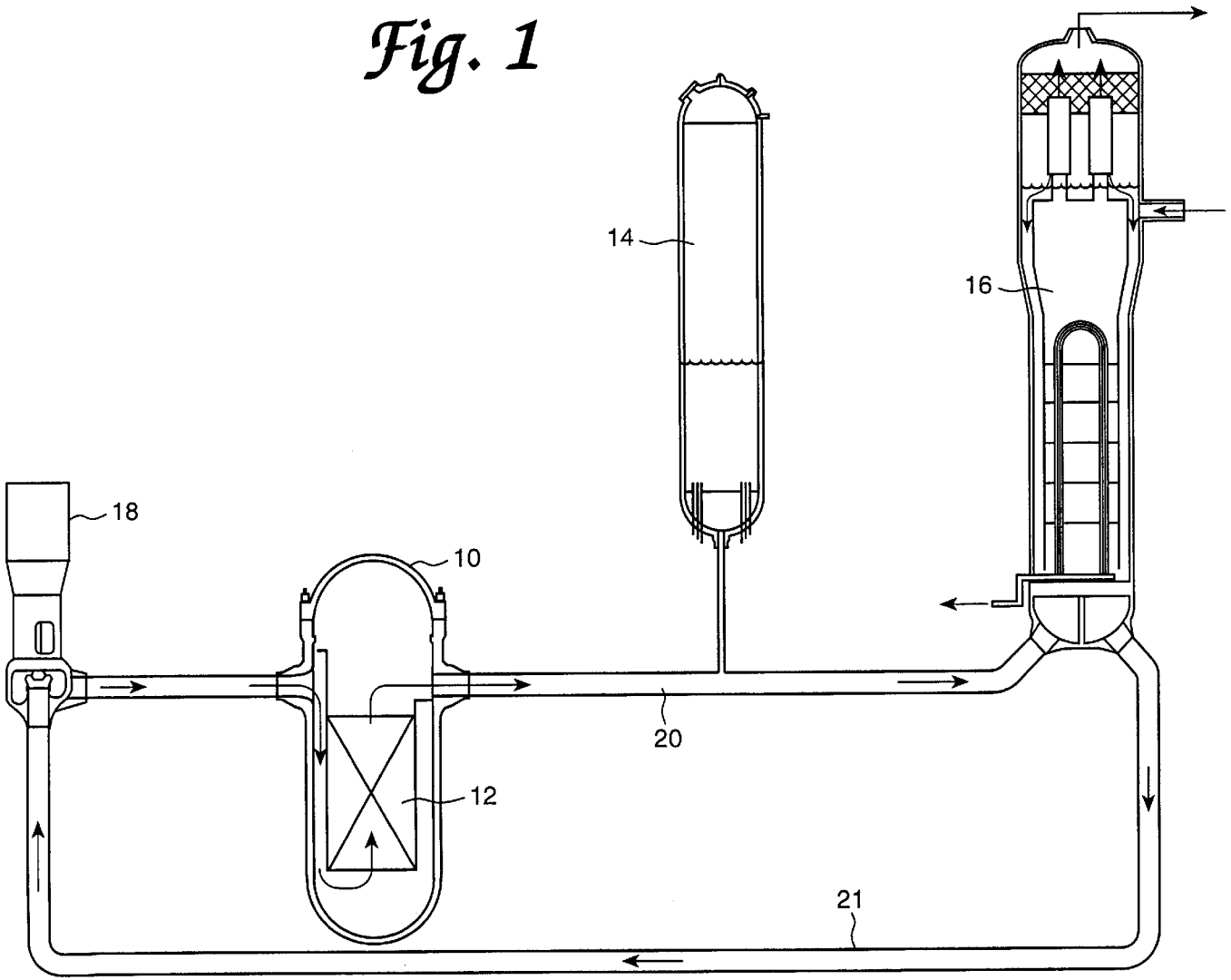
FIG. 1 is a schematic view representing the components and flow path of a conventional nuclear power plant having a steam generator.

A detailed description of the present invention is provided below.

In order to fully appreciate the present invention, a brief understanding of the general structure and design of a nuclear power plant is necessary. As shown in the accompanying drawings, a sludge removal system in accordance with the present invention is operated in a nuclear steam generator, which is designated generally by the reference numeral 16.

As shown in FIG. 1, a nuclear power plant generally includes a reactor vessel 10 having a reactor core 12, a pressurizer 14, a steam generator 16, and a reactor coolant pump 18. These devices collectively function to provide a continuous steam generation system. A primary fluid is circulated through the system by the reactor coolant pump 18, which drives the primary fluid through the reactor core 12 of the reactor vessel 10. The reactor core 12 heats the primary fluid to form a hot leg 20. The pressurizer 14 maintains the primary fluid under sufficient pressure to prevent it from boiling. The heated fluid then passes through the steam generator 16. As the primary fluid passes through the steam generator 16, heat is transferred from the primary fluid to a secondary fluid which is also circulated through the steam generator 16. The secondary fluid, generally water, is consequently transformed into steam, which is removed from the steam generator 16 in a continuous steam generation cycle. The cooled primary fluid exits the steam generator 16 in the form of a cold leg 21. The reactor coolant pump 18 thereafter recirculates the primary fluid, returning the primary fluid to the reactor vessel 10 for reheating.

Figure 2:
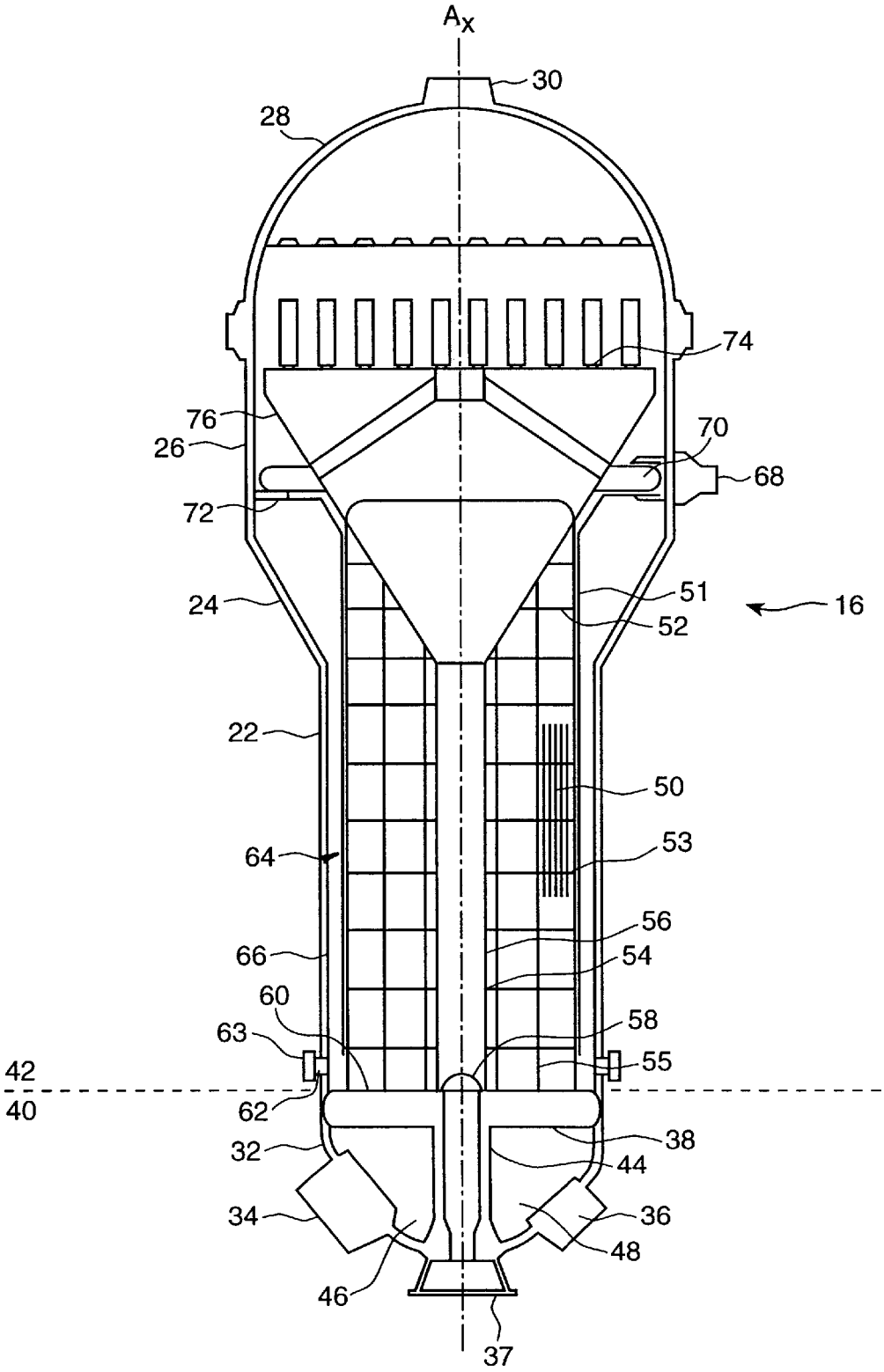
Fig. 2 (PRIOR ART)
FIG. 2 is a side cross-sectional view of a lower shell of a conventional steam generator illustrating a cross-sectional view of a tube bundle.
Figure 3:
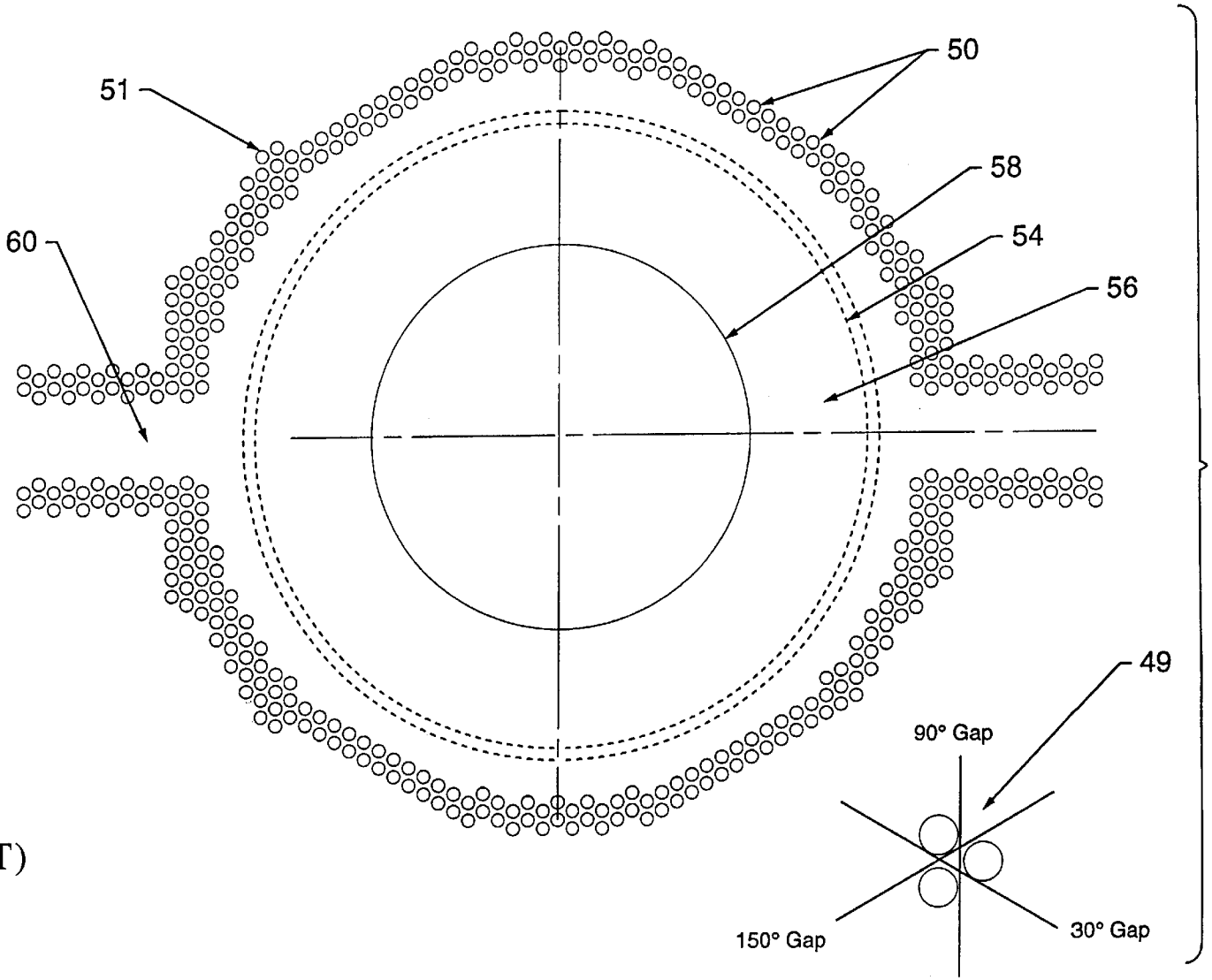
Fig. 3 (PRIOR ART)
FIG. 3 is a top cross-sectional view of a lower shell a conventional steam generator illustrating a triangular-pitch tube array of a tube bundle surrounding a central untubed region.

The steam generator 16 is hereinafter described with reference to FIGS. 2–3. The outer surface of the steam generator 16 includes a lower shell 22 that is connected to an intermediate frustoconical transition shell 24, that in turn is connected to an upper shell 26. A steam dome 28 having a steam nozzle 30 disposed thereon encloses the upper shell 26. A semi-spherical channel head 32 having an inlet nozzle 34 and an outlet nozzle 36 encloses the lower end of the lower shell 22. A ring-shaped pedestal 37 is positioned immediately under the channel head 32 for supporting the steam generator 16. As shown, the steam generator 16 is aligned along a generally longitudinal axis $A_x$. A horizontally oriented tubesheet 38 having tube holes (unnumbered) therein is attached to the lower shell 22 and the channel head 32 so as to separate a lower primary side 40 from an upper secondary side 42 of the steam generator 16. A dividing plate 44 radially disposed in the channel head 32 cooperates with the tubesheet 38 to divide the channel head 32 area into an entrance plenum 46 and an exit plenum 48. The entrance plenum 46 is in fluid communication with the inlet nozzle 34 for receiving heated primary fluid from the hot leg 20; by contrast, the exit plenum 48 is in fluid communication with the outlet nozzle 36 for returning cooled primary fluid to the cold leg 21.

A plurality of inverted U-shaped heat exchanger tubes 50 (FIG. 3) are disposed inside the steam generator 16 to form a tube bundle 51, indicated generally at 49. As shown in FIG. 3, the U-shaped tubes 50 are arranged in a triangular-pitch array. Each U-shaped tube 50 has a first elongated portion having an upper and a lower end, a second elongated portion having an upper and a lower end, and a U-shaped portion connecting the upper ends of the first and second elongated portions. The lower end of each first elongated portion is disposed in a hole (unnumbered) of the tubesheet 38 so as to come into fluid communication with the entrance plenum 46. The lower end of each second elongated portion is also disposed in a hole (unnumbered) of the tubesheet 38 so as to come into fluid communication with the exit plenum 48. Each U-shaped tube 50 is thereby disposed so that the first and second elongated portions extend vertically from their first ends through the secondary side 42. The U-shaped portion is disposed near the top of the transition shell 24.

In operation, the heated primary fluid enters the steam generator 16 through the inlet nozzle 34 and flows into the entrance plenum 46. From the entrance plenum 46, the primary fluid flows upward through the first elongated portion of the U-shaped tubes 50, through the U-shaped portion, and down through the second elongated portion of the U-shaped tubes 50 and into the exit plenum 48. Finally, the primary fluid is discharged from the steam generator 16 through the outlet nozzle 36.

A plurality of horizontally oriented upper annular support plates 52 and lower tubeplate or eggcrate supports 53 having an annular positioned support ring 54 are periodically spaced along the secondary side 42 for securely mounting and uniformly spacing the U-shaped tubes 50. Each support plate 52 and eggcrate support 53 has a series of holes contained therein for supporting the U-shaped tubes 50. The support plates 52 and eggcrate supports 53 are positioned in relation to each other so that the holes therein are aligned.

The elongated portions of each U-shaped tube 50 are accommodated within the holes of the support plates 52 and eggcrate supports 53. Vertically oriented tie rods 55 are disposed within the lower shell 22 to provide additional support for the U-shaped tubes 50.

A centrally located cylindrically-shaped untubed region 56 is provided in the illustrated steam generator design at the center of the tube bundle 51. The central untubed region 56 extends longitudinally along the central vertical axis of the lower shell 22. The periphery of the central untubed region 56 is defined by the elongated portions of the U-shaped tubes 50, the center portion of the annular support plates 52 and the annular-positioned support rings 54. A staydome 58 having a semi-spherical shape is concentrically positioned on the upper face of the tubesheet 38 and defines the bottom of the central untubed region 56. The top of the central untubed region 56 is defined by the U-shaped portion of the U-shaped tubes 50.

A blowdown lane 60 in the form of an untubed corridor extends across the diameter of the lower shell 22 and intersects a diameter of the central untubed region 56. The blowdown lane 60 is defined by an approximately four-inch wide gap separating the first elongated portions and the second elongated portions of the U-shaped tubes 50. Vertically oriented tie rods 55 bisect the width of the blowdown lane 60, dividing it into two lanes having an approximately 1¾ inch wide width. A hand hole 62 is formed in the lower shell 22 and located slightly above the tubesheet 38. The hand hole 62 is positioned in alignment with the blowdown lane 60, thereby allowing for access to the central untubed region 56. During operation of the steam generator 16, a hand hole cover 63 is placed in sealing engagement with the hand hole 62 for preventing secondary fluid from escaping.

A cylinder-shaped wrapper 64 surrounds the outer periphery of the tube bundle 51. The wrapper 64 has a diameter that is slightly smaller than the diameter of the lower shell 22, allowing the wrapper 64 to be positioned inside of and uniformly spaced from the lower shell 22. The uniform space provided between the outer face of the wrapper 64 and the inner face of the lower shell 22 defines an annular chamber 66.

A feedwater inlet nozzle 68 is located at the lower portion of the upper shell 26 for introducing secondary fluid into the steam generator 16. An annular feed water ring 70 is in fluid communication with the feedwater inlet nozzle 68. The feed water ring 70 is disposed about the inner face of the upper shell 26. The feed water ring 70 is maintained in place by an annular-shaped feed water ring support 72 which is attached to the inner face of the upper shell 26.

In operation, secondary fluid is introduced into the steam generator 16 through the feed water inlet nozzle 68. The secondary fluid then flows into the feed water ring 70, which distributes the secondary fluid about the circumference of the upper shell 26. From the feed water ring 70, the secondary fluid flows down the annular chamber 66 until it contacts the tubesheet 38. The secondary fluid is then dispersed along interstitial gaps located between the elongated portions of the U-shaped tubes 50. The secondary fluid thereby comes into fluid communication with the peripheral surfaces of the U-shaped tubes 50. Heat is consequently transferred from the primary fluid circulating through the U-shaped tubes 50 to the secondary fluid on the opposite side of the U-shaped tube walls. The secondary fluid is heated and converted into steam. The steam rises through the interstitial gaps provided between the U-shaped tubes 50 and enters the upper shell 26 of the steam generator 16. The steam then comes into contact with a positive entrainment steam dryer shelf 74 that is disposed in the upper shell 26 of the steam generator 16. The steam dryer shelf 74 extracts water from the wet steam. A steam nozzle 30 is provided above the steam dryer shelf 74 for transporting the dried steam from the steam generator 16 and to a turbine (not shown). A conically-shaped second wrapper 76 is disposed below the steam dryer shelf 74. The second wrapper 76 provides a path for removing extracted water from the steam dryer shelf 74 and returning it to the annular chamber 66, where it is recycled to the tube bundle 51.

Impurities and chemicals in the secondary fluid are left behind in the steam generator 16. These impurities manifest in the form of a corrosive sludge. The sludge accumulates on the outer peripheral surfaces of the U-shaped tubes 50, on the upper and lower surfaces of the support plates 52 and eggcrate supports 53, and on the tubesheet 38. The present invention, herein described, is a system for removing accumulations of sludge in order to increase heat transfer efficiency and prevent corrosion of the steam generator 16.

It is understood by those skilled in the art that a variety of designs and configurations have been proposed and used in constructing steam generators. The scope of the present invention is in no way limited to steam generators having the above-described design.

As shown in the accompanying drawings, preferred embodiments of a sludge removal system in accordance with the present invention are designated generally by the reference numeral 100.

Figure 4:
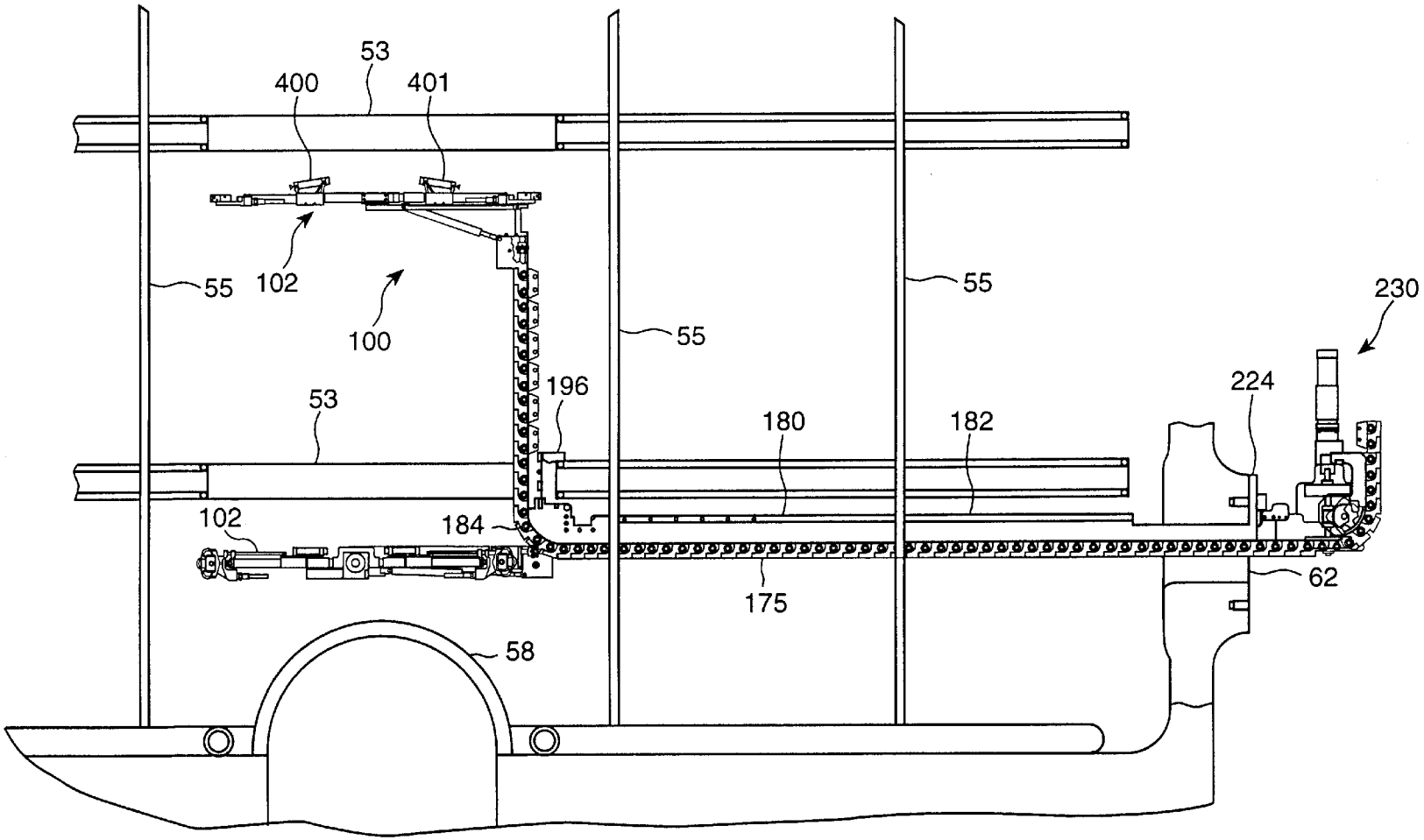
FIG. 4 is a comparative side view of a sludge removal system shown in both a deployment position and an operative position as encompassed by the present invention.

As shown in FIG. 4, the sludge removal system 100 is defined by an end effector 102 and a deployment system 175 for deploying the end effector 102 from a pre-deployed configuration to an operative position at an elevated portion of the central untubed region 56 of the steam generator 16.

Figure 5:
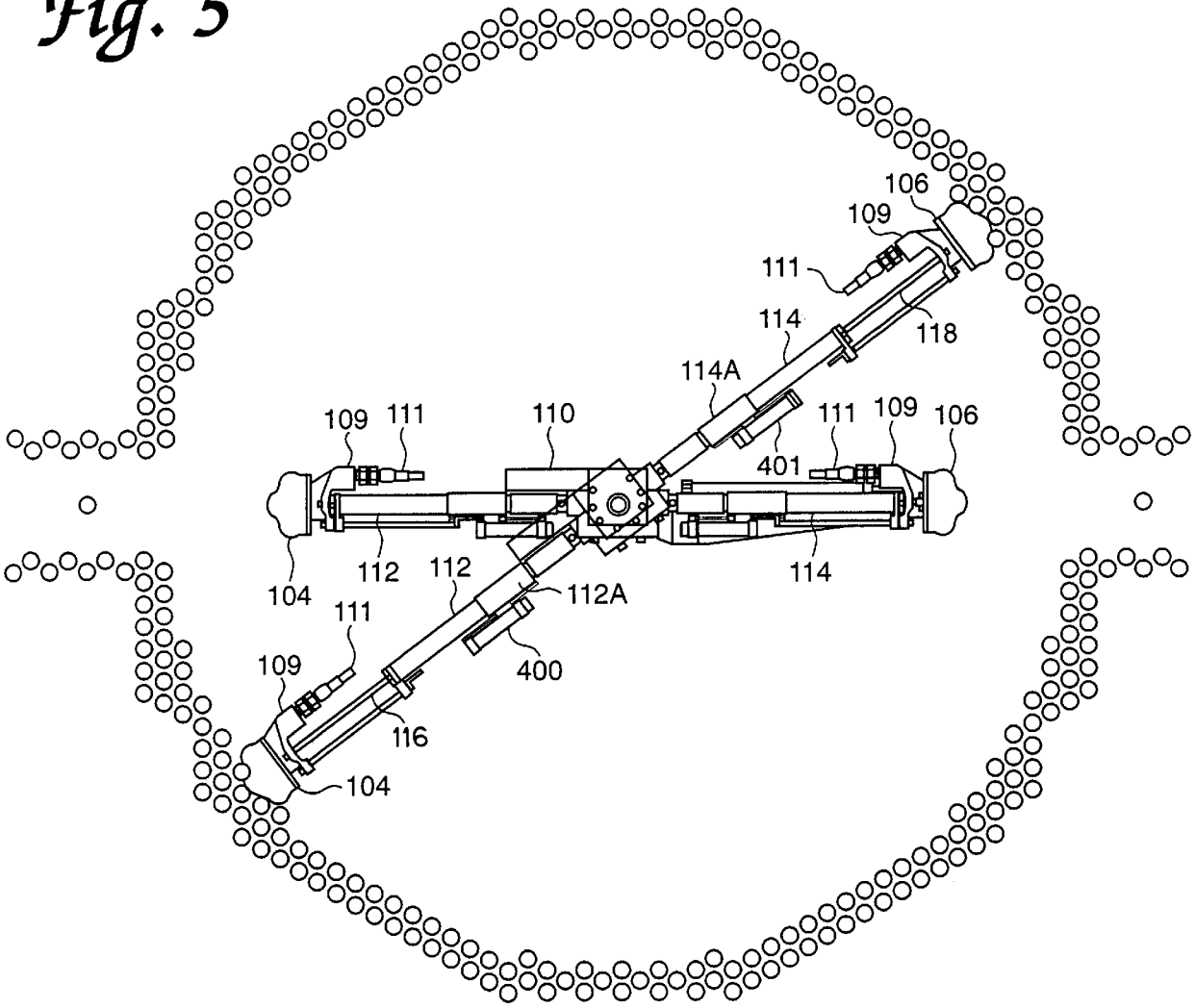
FIG. 5 is a comparative top plan view of the end effector shown in both a retracted position and an extended position as encompassed by the present invention.
Figure 6:
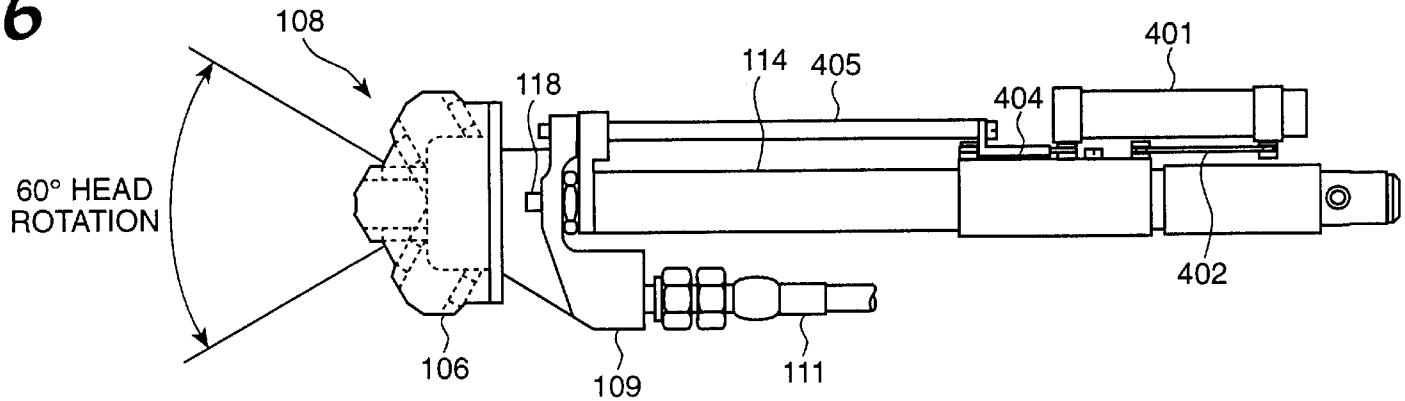
FIG. 6 is a partial exploded side view of the end effector as encompassed by the present invention.

As shown in FIGS. 5 and 6, the end effector 102 generally includes a first articulated nozzle head 104 and a second articulated nozzle head 106, a plurality of nozzle jets 108, a rotational drive unit 110, and a first arm 112 having a first pneumatic extension arm actuator 116 accommodated therein, and a second arm 114 having a second pneumatic extension arm actuator 118 accommodated therein.

The first arm 112 and first extension arm 116 combine to connect the first nozzle head 104 to the rotational drive unit 110. Similarly, the second arm 114 and the second extension arm 118 combine to connect the second nozzle head 106 to the rotational drive unit 110. The first arm 112 and the second arm 114 are mounted to the rotational drive unit 110 by a first arm mount **112*a* and a second arm mount 114*a*, respectively. The first arm 112 and second arm 114 are positioned in a collinear relation on opposing sides of the rotational drive unit 110**.

As shown in FIG. 6, each nozzle head 104 and 106 is pivotally connected to a respective extension arm 116 and 118. Each nozzle head 104 and 106 has a nozzle face that is defined by a central lobe and peripheral lobes on each side of the central lobe, with a recess intermediate of each lobe. The nozzle heads 104 and 106 are thereby free to pivot within a horizontal plane approximately ±30 degrees with respect to the axis of the respective extension arm 116 and 118. The nozzle heads 104 and 106 are preferably fabricated from steel or Delrin.

In operation, the end effector 102 is preferably disposed in the steam generator 16 so that the rotational drive unit 110 is positioned concentrically along the longitudinal axis $A_x$ of the central untubed region 56. The nozzle heads 104 and 106 are placed in a retracted position during installation and removal (discussed below) of the end effector 102 from the steam generator 16. The nozzle heads 104 and 106 are maneuvered into the retracted position by depressurizing the spring-loaded pneumatic first and second arms 112 and 114 such that the first and second pneumatic extension arm actuators 116 and 118 are retracted into their corresponding arms 112 and 114, respectively, by springs (not shown) contained therein.

The first and second extension arm actuators 116 and 118 are operated by pressurizing the first and second arms 112 and 114, respectively. The first and second nozzle heads 104 and 106 are thereby radially displaced into an operative position, wherein the nozzle heads 104 and 106 are extended in an outward direction until they engage the U-shaped tubes 50 along the periphery of the central untubed region 56. The pivotal movement and respective faces of the articulated nozzle heads 104 and 106 function to facilitate accurate alignment and engagement with the U-shaped tubes 50 as shown in FIG. 5. As shown therein, the central lobe is received into the interstitial gap between two adjacent U-shaped tubes 50. The two adjacent U-shaped tubes 50 are thereby received into the respective recesses located on opposing sides of the central lobe. During radial displacement, the extension arm actuators 116 and 118 each provide up to 32 pounds of force when supplied with 80 psig air. When the extension arm actuators 116 and 118 are secured in their extended positions, the nozzle heads 104 and 106 exert no more than 6 pounds of force on any one U-shaped tube 50. This results in an acceptable bending stress of less than 7 ksi imparted on the U-shaped tube 50.

The nozzle heads 104 and 106 preferably each contain six water nozzle jets 108 which are inserted therein or attached thereto. The nozzle jets 108 are arranged at 0, 60, and 300 degree increments with respect to the longitudinal axis of the respective arm 112 and 114. The nozzle jets 108 are thereby closely aligned with the 30, 90, and 150 degree intertube gaps formed by the U-shaped tubes 50 in the triangular-pitch tube array 49 shown in FIG. 3. After the nozzle heads 104 and 106 are placed into their operative positions, the nozzle jets 108 of each nozzle head 104 and 106 are fed with high-pressure water through corresponding manifolds 109. The manifold 109 of each nozzle head 104 and 106 is supplied with water from a high pressure hose (not shown) that is connected to the manifold 109 by a water line connector 111. The water line connector 111 and the nozzle head manifold 109 are connected to one another through a pressure-balanced seal assembly (not specifically shown) which permits the nozzle heads 104 and 106 to pivot with respect to the corresponding water line (not shown) and the corresponding connector 111. The high-pressure water discharges from the nozzle jets 108 and collides with sludge deposits, dislodging the sludge deposits from the U-shaped tubes 50, support plates 52, and eggcrate supports 53.

The close contact between the clover-shaped face nozzle heads 104 and 106 with the U-shaped tubes 50 restricts the amount of splash-back which might occur as the pressurized water disperses after leaving the nozzle jets 108. The combined jet reaction forces generated by the pressurized water leaving the diametrically opposing nozzle heads 104 and 106 are balanced to reduce undesired resultant forces on the end effector 102 and the vertical deployment system 175.

The nozzle heads 104 and 106 may be incrementally rotated about the central untubed region 56 to contact any of the U-shaped tubes 50 about the periphery of the central untubed region 56. To accomplish the rotational movement, both of the nozzle heads 104 and 106 are first maneuvered into a retracted position by depressurizing the first and second arms 112 and 114 so that the respective springs contained therein radially retract the first and second pneumatic extension arm actuators 116 and 118. The nozzle heads 104 and 106 are retracted a sufficient distance away from the U-shaped tubes 50 in a radially inward direction such that the end effector 102 can be rotated without contact between the U-shaped tubes 50 and the nozzle heads 104 and 106.

Figure 7:
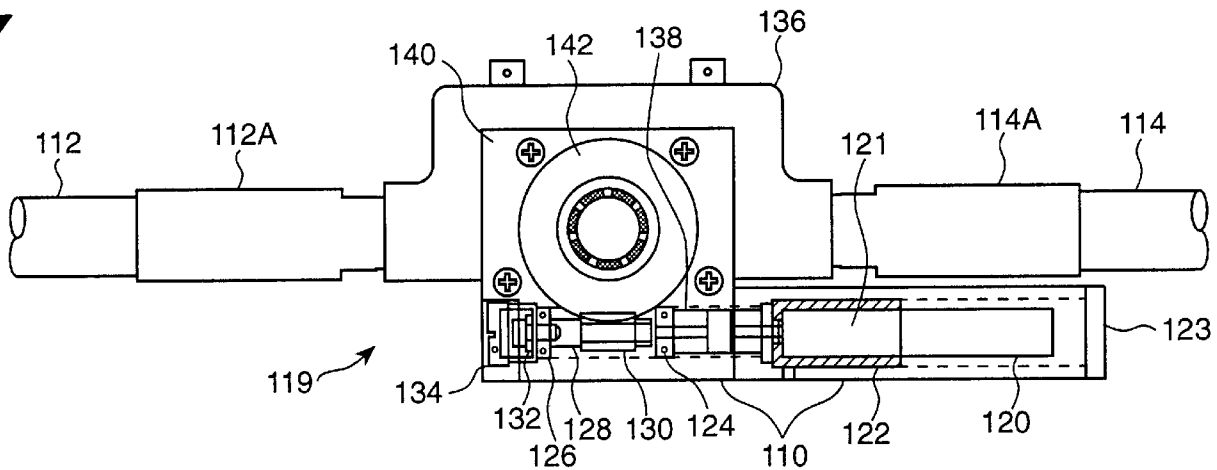
FIG. 7 is an exploded top plan view of a rotational drive means of an end effector as encompassed by the present invention.

The rotational drive unit 110 is actuated to allow rotational movement of the arms 112 and 114 in tandem, along with the corresponding nozzle heads 104 and 106. As shown in FIG. 7, a motor 120 (preferably driven by a DC voltage) is utilized for driving the rotational drive unit 110. A gear head reduction system 121 is coaxially provided with the motor 120 for increasing the torque imparted from the electric motor. The motor 120 and the gear head reduction system 121 are supported and secured by a support sleeve 122. The motor 120, gear head reduction system 121, and sleeve support 122 are provided in a housing 123.

A worm shaft 128 is coaxially mounted to the gear head reduction system 121 and extends from the housing 123 and into the drive housing 148 (FIG. 8) of the rotational drive unit 110. The worm shaft 128 imparts rotational movement to a worm 130 that is coaxially mounted thereon. The worm 130 has a screw-threaded portion (not shown). A first radial bearing 124 and second radial bearing 126 are provided on opposing sides of the worm 130 for accommodating radial load. The worm shaft 128 is maintained in axial alignment by end cap closure 134. Thrust washer 132 prevents the disengagement of the worm shaft 128 from the end cap closure 134.

A worm gear 142, having an axis of rotation that is perpendicular to the worm shaft 128, engages the screw-threaded portion of the worm 130, thereby imparting rotational movement to the worm gear 142. A flexible coupling 138 is positioned intermediate the gear head reduction system 121 and the first radial bearing 124 for preventing disengagement between the worm 130 and worm gear 142.

Figure 8:
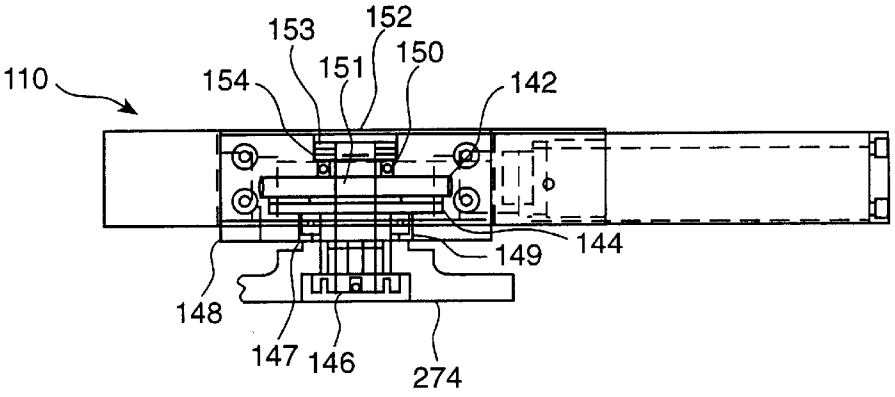
FIG. 8 is an exploded cross-sectional side view of a reduction gear arrangement of a rotational drive means as encompassed by the present invention.

As shown in FIG. 8, the worm gear 142 is mounted upon a central rotating shaft 151 to thereby impart a rotational movement thereto. The central rotating shaft 151 is positionally aligned by a lower radial bearing 149 and an upper radial bearing 150, which are located on opposing ends of the worm gear 142. Bellville washer 153 and thrust washer 154 positioned above the worm gear 142 and an adjustable thrust collar 146 positioned at the lower end of the central rotating shaft 151 are provided for supporting the shaft 151.

A radial bearing capture ring 147 is positioned between the lower radial bearing 149 and the housing 148. The radial bearing capture ring 147 functions to mate the lower radial bearing 149 with the housing 148. The radial bearing capture ring 147 thus causes the rotational movement of the lower radial bearing 149 to be imparted upon the housing 148, thereby rotating the housing 148 in relation to folding arm 274. The housing is connected to the first and second arm mounts 112*a* and 114*a* by yoke support 136. Cover plate 140 encloses the housing 148.

An emergency slip clutch 144 is also provided in case the rotational drive unit 110 should fail. The slip clutch 144 is positioned immediately below the worm gear 142 and includes separate upper and lower portions (unnumbered), with the upper portion being connected to the worm gear 142 and the lower portion being connected to the lower radial bearing 149. The upper and lower portions of the slip clutch 144 are brought into frictional contact by tightening a central rotation shaft collar 152, which applies a load to the bellville washers 153 and thrust washer 154 positioned above the upper portion of the slip clutch 144.

A sufficient torsional force must be imparted from the motor 120 in order to override the frictional contact between the two portions of the slip clutch 144. Moreover, if the rotational drive unit 110 fails, the slip clutch 144 allows the user to reach into the steam generator 16 and rotate the end effector 102 so that it can be removed therefrom.

It is understood that various types of motors may be used in connection with the rotational drive unit 110 of the present invention, including electronic and fluidic (e.g., pneumatic, hydraulic) motors or manual operation. In addition, various reduction gear arrangements may be incorporated for imparting a sufficiently reduced rotational velocity to the nozzle heads 104 and 106.

The vertical deployment system 175 delivers and supports the end effector 102 in a manner that assures accurate positioning of the nozzle jets 108 and improves the retrievability of the sludge removal system 100 in the event of catastrophic failure. The preferred embodiment for deploying the end effector 102 into the desired portion of the steam generator 16 includes a self-erecting load-bearing chain 200 and a supporting segmented support rail 180. A SERAPID chain, available commercially from Serapid of Londinieres, France under Model 40 PS, is representative of the type of chain 200 intended for use in the present invention, with several modifications made thereto.

Figure 9:
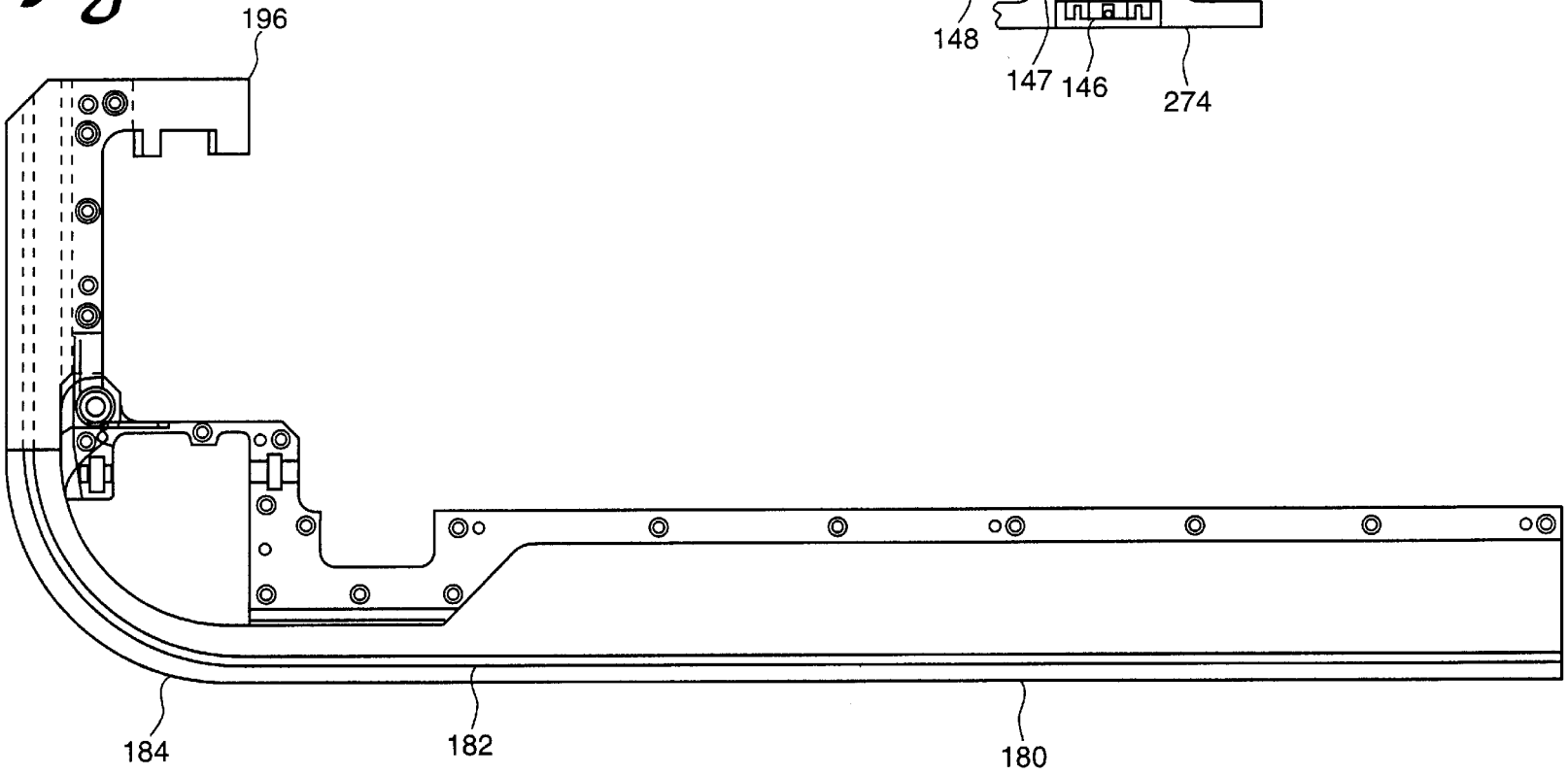
FIG. 9 is a side view of a support rail as encompassed by a first embodiment of a deployment system of the present invention.

As shown in FIG. 9, the segmented support rail 180 includes a substantially straight rail section 182 and a curved rail section 184. The straight rail section 182 of the support rail 180 is defined by a series of interconnecting segments; the curved rail section 184 is formed from one integral segment. A spring-loaded hook 196 is located at the distal end of the support rail 180.

Figure 10:
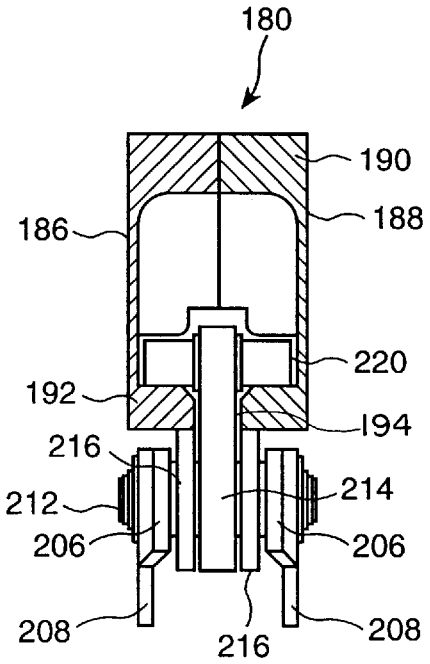
FIG. 10 is an exploded cross-sectional front view of a support rail and a chain as encompassed by a first embodiment of a deployment system of the present invention.

As shown in FIG. 10, each segment of the support rail 180 is defined by a base 192 having a channel 194 located therein. A first side 186 and a second side 188 extend perpendicularly from opposing ends of the base 192. A top 190 connecting the first side 186 and the second side 188 opposes the base 192.

Figure 11:
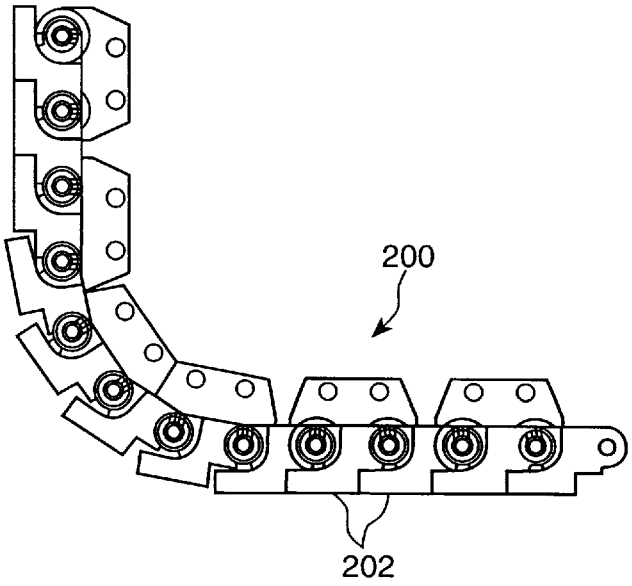
FIG. 11 is a side view of a chain as encompassed by a first embodiment of a deployment system of the present invention.

As shown in FIGS. 10–11, the chain 200 as encompassed by a preferred embodiment of the present invention is defined by a plurality of links 202 that are arranged in an end-to-end manner. The links 202 are constructed and arranged such that when the chain 200 is in a straight, elongated configuration, movement of each link 202 thereof is restricted to one direction with respect to its adjacent links 202. The construction and arrangement of the chain 200 thereby allows for collinear stacking of the links 202 as shown in FIG. 11. When in its stacked arrangement, the stacked chain 200 exhibits a large load-bearing capacity.

Each link 202 includes two opposing Z-shaped end brackets 206 having a pin 212 extending therebetween. The lower portion of each end bracket 206 serves as a stop 208 for maintaining the chain in a stacked arrangement. The upper portion of each end bracket 206 has a first and a second aperture (unnumbered). The end brackets 206 of each link 202 are constructed and dimensioned such that the opposing first apertures are spaced further apart from each other than the opposing second apertures. The pin 212 is disposed through the first apertures in each of the opposing end brackets 206 to secure the two end brackets 206 of the respective link 202 in an opposing position. Each particular link 202 shares its pin 212 with one of the links adjacent thereto. Moreover, each particular link 202 also shares the pin 212 of its other adjacent link, such that the pin of the other adjacent link is disposed through the second apertures of the particular link 202. Thus, each pin 212 is disposed between the first apertures of and second apertures of two adjacent links, respectively. The pins 212 thereby connect adjacent links 202. Accordingly, there is a one-to-one ratio of pins 212 to links 202.

The chain 200 as defined by the present invention preferably replaces the pins of a standard SERAPID chain with shorter pins 212 to reduce the overall width of the chain 200 from 1.810 inches to 1.625 inches.

The plurality of links 202 are suspended from the support rail 180 by a plurality of hangers 214, each having chamfered upper corners. Two upper and two lower apertures are located in each hanger 214. Each hanger is attached to adjacent links 202, so that the ratio of links 202 to hangers 214 is two-to-one. The lower portion of each hanger 214 is coupled between and secured to the end brackets 206 of adjacent links 202 by the pins 212 thereof. The pins 212 of the respective links 202 each engage one of the two lower apertures of the hanger 214. The hanger 214 is thereby positioned intermediate the end brackets 206 of each of the respective links 202. A pair of journal bearings 216 is axially mounted on each link 202 by pin 212. The journal bearings 216 are mounted between the end brackets 206 and on opposing sides of the hanger 214. A snap ring (unnumbered) secures the end brackets 206, journal bearings 216, and lower portion of the hanger 214 on the pin 212.

The upper portion of each hanger 214 extends through the channel 194 located in the base 192 of the support rail 180. For each hanger 214, two cylindrical rollers 220 respectively engage the two upper apertures of the hanger 214. The cylindrical rollers 220 are disposed within the support rail 180 so that the cylindrical rollers 220 rest along the upper surface of the base 192 of the support rail 180. The cylindrical rollers 220 thereby secure the chain 200 to the support rail 180 for allowing movement of the chain 200 along the length of the support rail 180. The end brackets 206, journal bearings 216, pin 212, and snap ring (unnumbered) are all suspended below the support rail 180 by the hangers 214.

The end effector 102 is attached to the first link 204 located at the distal end of the chain 200.

In operation, the sludge removal system 100 is introduced into the steam generator 16 by first removing the protective hand hole cover 63 from the hand hole 62. A protective hand hole interface 224 is placed over the exposed face of the hand hole 62 to safeguard the hand hole 62 from damage. Next, the curved rail section 184 of the support rail 180 is inserted into the steam generator 16 by negotiating the curved rail section 184 through the exposed hand hole 62. The spring-loaded hook 196 attached to the terminal end of the curved rail section 184 is set into a retracted position. A cable (not shown) is attached to the spring-loaded hook 196 for actuating the spring-loaded hook 196 into its operative position.

Once inserted, the curved rail section 184 is arranged along the blowdown lane 60 so that the distal end of the curved rail section 184 extends in an upward direction. Next, a straight rail section 182 segment is attached to the proximal end of the curved rail section 184. The longitudinal length of the support rail 180 is further increased by thereafter sequentially attaching additional straight rail section 182 segments and further passing the support rail 180 through the exposed hand hole 62 and along the blowdown lane 60. A sufficient number of straight rail section 182 segments are attached to allow the distal end of the second rail section 184 to reach the central untubed region 56. A final lifting-lever section (not shown) is attached to the proximal end of the support rail 180. The cable is then activated to move the spring-loaded hook 196 from its retracted position to its operative position. The lifting lever section provides a means for lifting the distal end of the support rail 180 and negotiating the spring-loaded hook 196 into engagement with the eggcrate support ring 54 located directly above the support rail 180. The force exerted by the weight of the support rail 180 acts as a passive clamp to secure and stabilize the support rail 180. However, active clamps (not shown) may be used to provide additional stability. It is understood that alternative devices may be used for actuating the spring-loaded hook 196 (e.g., reach rod, remote control device) and for securing and stabilizing the support rail 180 (e.g., a kick stand). Once the spring-loaded hook 196 is properly engaged to lowest eggcrate ring 54, the lifting lever section is removed and the proximal end of the support rail 180 is affixed to the hand hole interface 224.

After securing the support rail 180, the cleaning end effector 102 and the chain 200 are inserted into the steam generator 16. A chain magazine or take-up mechanism (not shown) stores or tends the undeployed chain 200 outside of the steam generator 16.

Engagement of the chain 200 to the support rail 180 is achieved by inserting the cylindrical rollers 220 of the chain 200 into the cross-section of the support rail 180 at the proximal end thereof. The chain 200 is continuously fed from the take-up mechanism as a lateral force is applied to the proximal end of the chain 200 to maneuver it along the length of the support rail 180. The chain 200 is thereby extended along the longitudinal length of the straight rail section 182 of the support rail 180 until it reaches the curved rail section 184.

Figure 15:
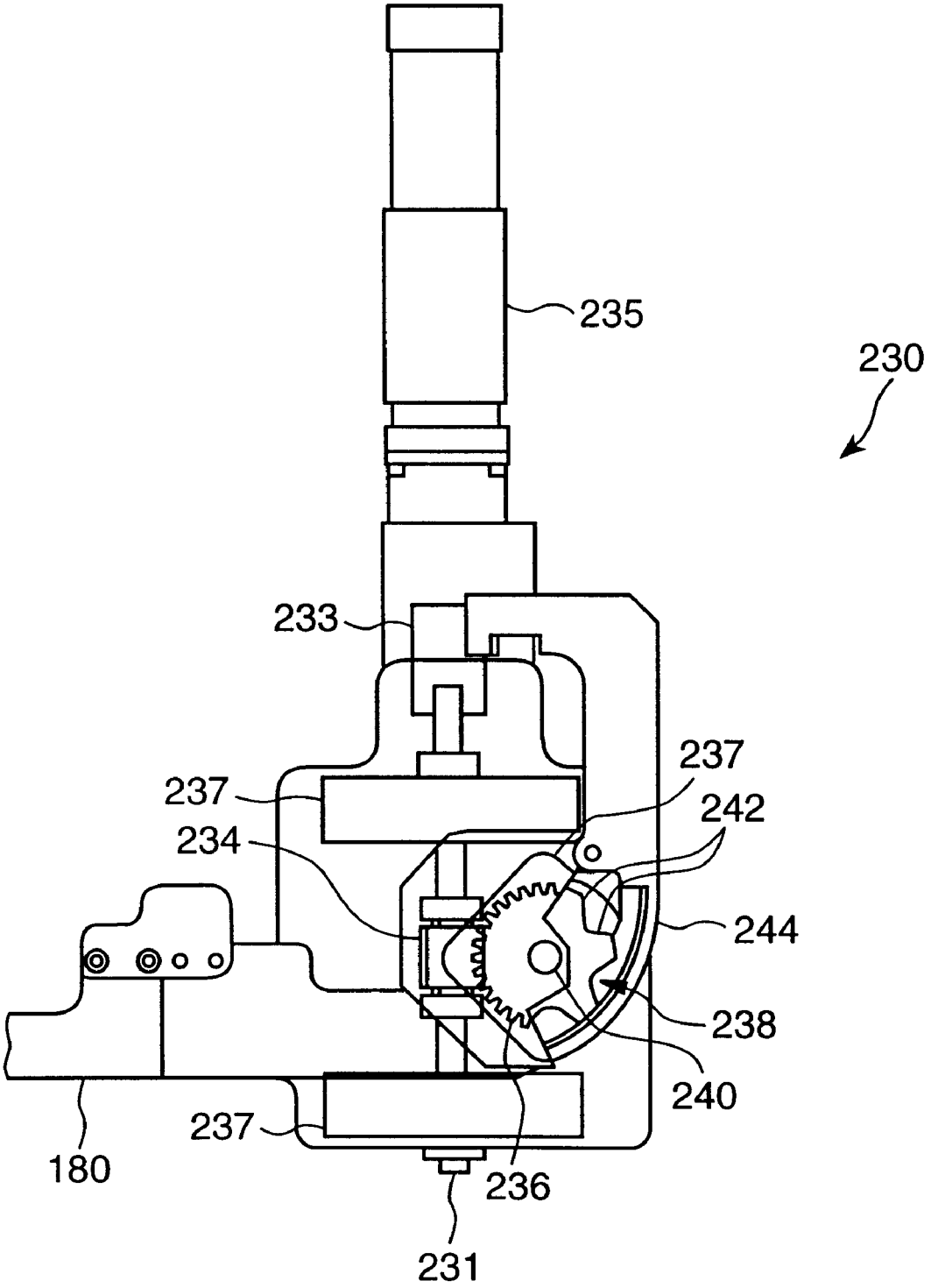
FIG. 15 is a side view of a drive mechanism assembly as encompassed by a first embodiment of a deployment system of the present invention.

The chain 200, when engaged in the support rail 180 as described above, is propelled along the support rail 180 by a drive mechanism 230, which is preferably mounted to the proximal end of the support rail 180 and disposed outside the hand hole 62 (FIG. 4). As shown in FIG. 15, the drive mechanism 230 includes a worm 234, a worm gear 236, a double-lobe sprocket wheel 238, a worm shaft 231, a worm gear shaft 240, a drive motor 235, and a curved rail segment 244, which also acts as a housing for the sprocket wheel 238. The drive motor 235 may be, for example, electrically, pneumatically, hydraulically, or manually (e.g., manual crank) operated.

The drive motor 235, which is connected to the worm shaft 231 by a flexible coupling 233, imparts a rotational movement to the worm shaft 231 and the worm 234 mounted thereon. The worm 234 is placed in positional engagement with the worm gear 236, which is mounted on the worm gear shaft 240. The worm 234 and worm gear 236 are secured in positional engagement by respective pairs of pillow block bearings 237, which are respectively positioned at the ends of the worm shaft 231 and the worm gear shaft 240. The worm 234 and worm gear 236 rotate about their respective axes (i.e., shafts), which are transversely positioned. As a result, when the drive motor 235 is engaged to rotate the worm 234, the interaction between the "screw-faces" of the worm 234 and worm gear 236 allows a rotational movement and a torque to be imparted to the worm gear 236. The worm gear 236 transmits the torque to the worm gear shaft 240 by means of a key-keyway arrangement (not shown). The worm gear shaft 240 in turn transmits torque to the double-lobed sprocket wheel 238 by means of another second key-keyway arrangement (not shown).

The sprocket wheel 238 is preferably located within a second curved rail segment 244, which preferably has a substantially similar geometry to the curved rail segment 184 located inside the steam generator 16. The second curved rail segment 244 is connected to the proximal end of the support rail 180 and is preferably located outside of the steam generator 16. The double-lobed sprocket wheel 238 has pairs of spaced teeth 242 that are constructed and oriented to allow engagement thereof with the cylindrical rollers 220 on both sides of the hangers 214 of the chain 200. The space (unnumbered) between each pair of teeth allows clearance between the sprocket wheel and the hangers 214 as the chain 200 is driven by the rotating sprocket wheel 238. When the cylindrical rollers 220 of the chain 200 are engaged in the sprocket teeth 242 and the drive motor 235 is powered, the sprocket wheel 238 imparts lateral forces on the cylindrical rollers 220, which serve to translate the chain 200 along the straight rail section 182 towards the central untubed region 56, where it engages the curved rail section 184. The curved rail section 184 guides the chain 200 about a ninety degree turn, redirecting the chain 200 into a vertically ascending direction within the untubed region 56.

As the chain 200 is driven along the curved rail section 184, the journal bearings 216 function as annular bearing rollers. The journal bearings 216 contact the lower face of the base 192 of the curved rail section 184, thereby averting direct contact between the base 192 of the curved rail section 184 and the chain 200. Undue wear to the chain 200 is thereby avoided.

Figure 12:
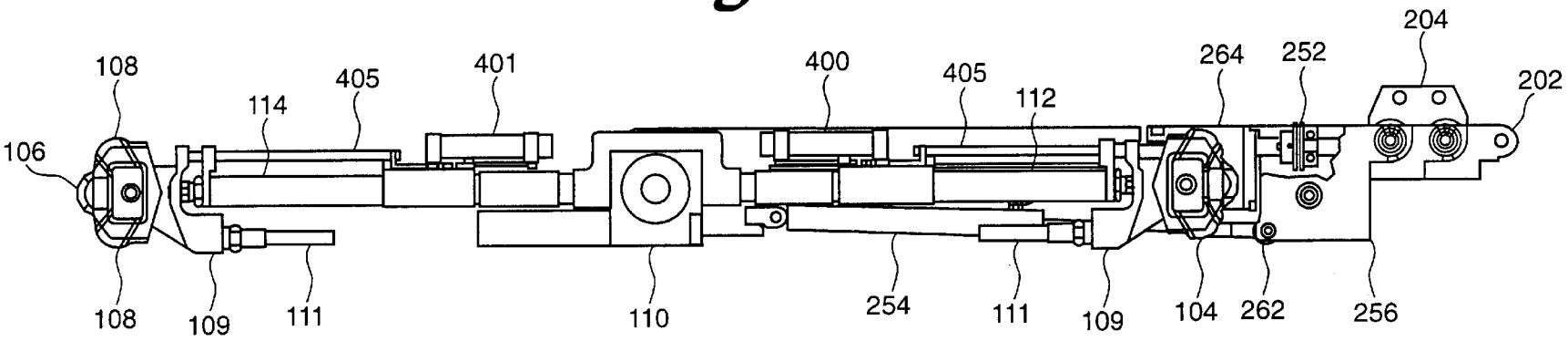
FIG. 12 is a side view of an end effector and connection assembly in a deployment position as encompassed by a first embodiment of a deployment system of the present invention.
Figure 13:
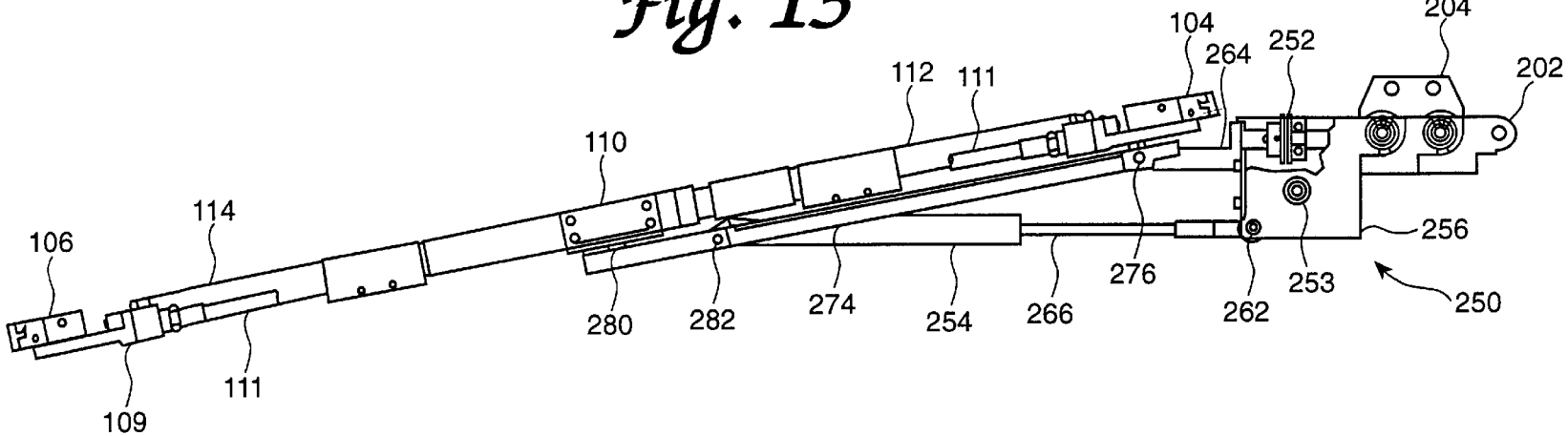
FIG. 13 is a side view of an end effector and connection assembly in an intermediate position as encompassed by a first embodiment of a deployment system of the present invention.
Figure 14:
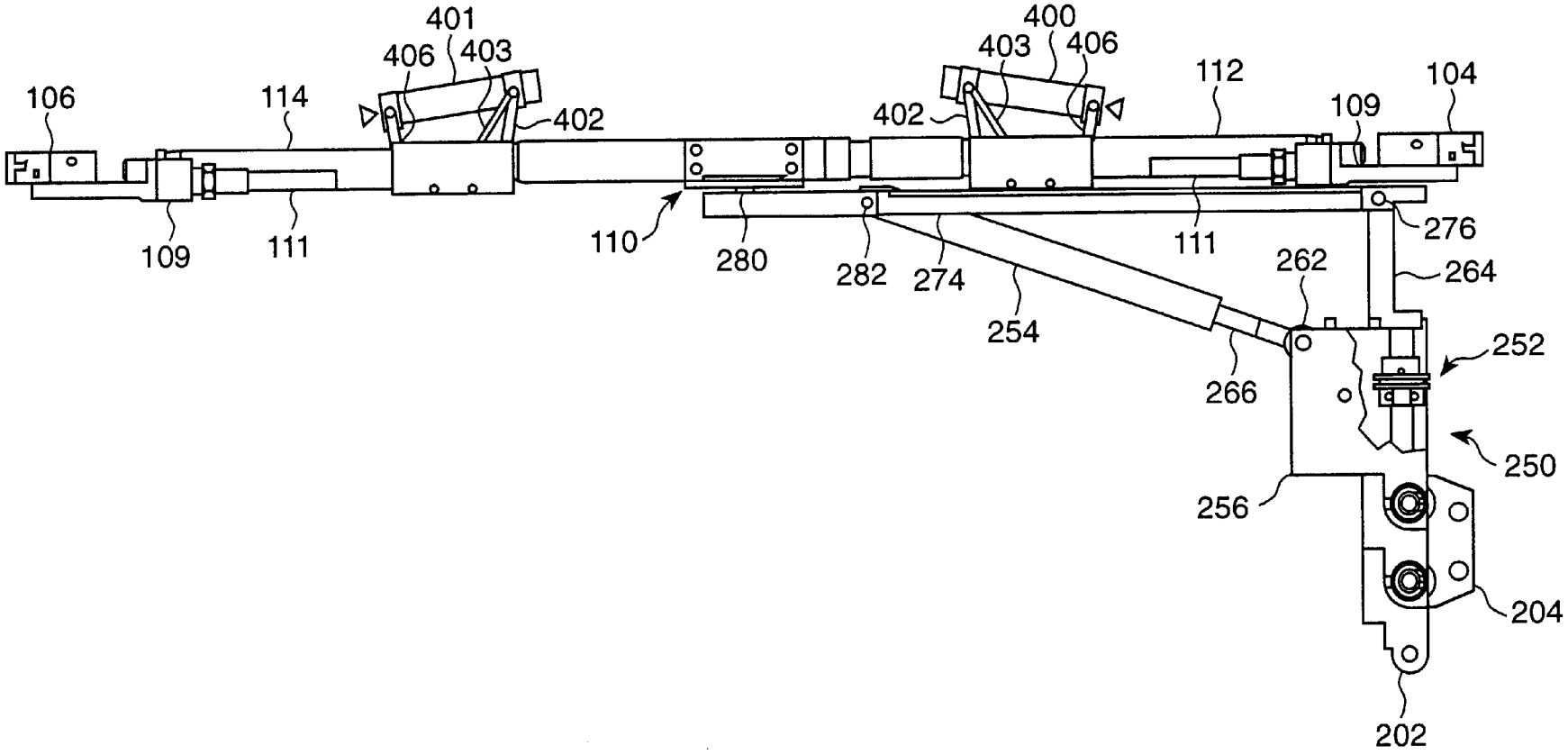
FIG. 14 is a side view of an end effector and connection assembly in an operative position as encompassed by a first embodiment of a deployment system of the present invention.

As shown in FIGS. 12–14, the end effector 102 is attached to the first link 204 located at the distal end of the chain 200. As explained above, the blowdown lane 60 and vertically oriented tie rods 55 provide very restrictive spatial constraints for deploying the end effector 102. In view of these constraints, during passage through the blowdown lane 60 the longitudinal axis of the end effector 102 is preferably positioned in a collinear relationship with the longitudinal axis of the chain 200 in order to negotiate the end effector 102 through the blowdown lane 60 and past the tie rods 55. Moreover, the end effector 102 is preferably oriented at a ninety degree rotation about its longitudinal axis as compared to its operating position.

A connector assembly 250 (see FIG. 13) is situated intermediate the end effector 102 and the distal end of the chain 200 for securing the end effector 102 to the chain 200. The connector assembly 250 allows for the cable-actuated rotation of the end effector 102. According to one embodiment of the present invention, a cable (not shown) is fixed at approximately its midpoint to a first pulley 252, thereby forming two cable portions (not shown) of substantially equivalent lengths extending from the first pulley 252. The two cable portions are threaded through respective tracks (unnumbered) circumferentially located in a second pulley 253. Respective sheathed segments of the two cable portions are run from the second pulley 253, along the chain 200, and to the hand hole 62.

The first pulley 252 is concentrically mounted on a keyed shaft (unnumbered). The shaft is mounted through two holes located at opposite ends of a knuckle piece 256. The distal end (unnumbered) of the shaft is integrally connected to a first end (unnumbered) of a yoke 264. By applying tension to one portion of the cable, the operator can apply a torque via the second pulley 253 to the first pulley 252, which is attached to the cable. This torque is transmitted to the keyed shaft, which rotates about its longitudinal axis. Bearings (not shown) may be positioned on the opposite ends of the keyed shaft to facilitate this rotational movement. The integral connection between the keyed shaft and the knuckle 256 causes the knuckle 256 and the end effector 102 attached thereto by yoke 264 to rotate ninety (90) degrees about the longitudinal axis of the shaft.

The second end (unnumbered) of the yoke 264 is pivotally connected to a first end (unnumbered) of an elongated support plate 274 at joint 276 (see FIG. 13). The support plate 274 is connected to drive housing 148 through connector 280. The length of the support plate 274 is oriented substantially parallel to the longitudinal axis of the end effector 102.

The connector assembly further includes a hydraulic cylinder 254 having an extension rod 266 accommodated therein. The extension rod 266 extending from a first end (unnumbered) of the hydraulic cylinder 254 is pivotally mounted to the knuckle 256 at a pivot joint 262. The second end (unnumbered) of the hydraulic cylinder is pivotally mounted to the support plate 274 at a pivot joint 282.

During initial deployment of the end effector, the hydraulic cylinder 254 is in a pressurized state so that extension rod 266 extends a maximum length therefrom. After the end effector 102 has been passed through the blowdown lane 60, the extension rod 266 is retracted into the hydraulic cylinder 254, causing the support plate 274 to rotate the end effector 102 ninety (90) degrees about pivot 276. Accordingly, the end effector 102 and support plate 274 are pivoted from an alignment position in which the longitudinal axes thereof are substantially parallel to the chain 200 to an alignment position in which the longitudinal axes thereof are substantially perpendicular to the chain 200.

The cable-actuated rotation and the hydraulic cylinder 254 thereby combine to reorient the end effector 102 from its initial deployment position (FIG. 12) in the blowdown lane 60 to its final operative position in the central untubed region 56 of the steam generator 16 (FIG. 14).

As shown in FIG. 12, in order to achieve passage of the end effector 102 through the blowdown lane 60, the end effector 102 is preferably oriented at a ninety (90) degree rotation about its longitudinal axis and positioned so that its longitudinal axis is in a collinear relationship with the longitudinal axis of the chain 200. As a result, the end effector 102 is improperly aligned when it reaches the central untubed region 56. Therefore, the end effector 102 is preferably realigned after it exits the blowdown lane 60 and enters the central untubed region 56. Realignment requires that the end effector 102 be rotated ninety degrees about its longitudinal axis. Realignment further requires that the end effector 102 be pivoted ninety degrees from an alignment position in which the longitudinal axis of end effector 102 is substantially parallel to the chain 200 to an alignment position in which it is substantially perpendicular to the chain 200.

In operation, after the chain 200 has engaged the curved rail segment 184 and initiated vertical deployment, the cable-actuated rotation and hydraulic cylinder 254 are actuated to reconfigure the end effector 102 into an operative position. By applying tension to one end of the cable attached to the pulley 252, the knuckle 256 and the end effector 102 are rotated about the axis of the shaft. Hard stops (not shown) on the knuckle 256 and yoke 264 prevent further rotation beyond ninety (90) degrees. The end effector 102 remains in a nearly collinear relationship with the chain 200, as shown in FIG. 13.

As explained above, the hydraulic cylinder 254 is in a pressurized state when the end effector 102 is inserted into the hand hole 62 and passed through the blowdown lane 60. After the end effector 102 reaches the curved rail segment 184 and begins its vertical ascent, the hydraulic cylinder 254 is actuated by venting the fluid therefrom. Venting the hydraulic cylinder 254 retracts the extension rod 266 accommodated therein, causing the support plate 274 and the end effector 102 attached thereto to pivot downward about pivot joint 276 until the end effector 102 rests on the staydome 58. The extension rod 266 of hydraulic cylinder 254 also pivots about pivot joint 262. The hydraulic cylinder 254 is then completely depressurized, allowing the end effector to continue to rotate downward as the chain 200 is further driven around the curved rail section 184 of the support rail 180. The end effector 102 continues its downward pivotal movement until the distal end of the chain 200 has travelled around the curved rail section 184. As shown in FIG. 14, the end effector 102 is thereby placed in its horizontally-oriented operative position, perpendicular to the axis of the chain 200.

The actuation of the cable-actuated rotation and the depressurizing of the hydraulic cylinder 254 may occur at any point in time after the end effector 102 has passed through the blowdown lane 60 and reached the curved rail segment 184. For instance, these steps may occur during or subsequent to the vertical deployment of the end effector 102.

It is further understood that the cable-actuated rotation and hydraulic cylinder 254 need not be cable-actuated or hydraulic, respectively. For instance, these actuating devices may be operated by various other means, including electrical, pneumatic, hydraulic, manual, or other equivalent designs.

Finally, the end effector 102 may incorporate a video inspection device for providing visual inspection of the tube bundle 51 and of the positioning of the end effector 102 during deployment. The video inspection device preferably includes two high-resolution color CCD cameras 400 and 401 having respective integral light sources. For example, two 12 mm diameter ELMO micro cameras with 5.5 mm focal length lenses may be used.

The cameras 400 and 401 are shown in an undeployed position (FIG. 6) and a deployed position (FIG. 14). The cameras 400 and 401 are respectively positioned adjacent to the first and second arms 112 and 114 for respectively monitoring the docking of the nozzle heads 104 and 106 to the U-shaped tubes 50. More specifically, an elongated linkage 402 pivotally connects the rear end of camera 400 to the first arm 112. A second linkage 406 similarly connects the front end of the camera to the first arm 112. A spring 403 applies a resilient force to the camera 400, pulling the camera towards a deployed position. An L-shaped bracket 404 (FIG. 6, showing camera 401) extends from a first end (unnumbered) of a support rod follower 405. A second end (unnumbered) of the support rod follower 405 is attached to manifold 109 at the distal end of the first extension arm actuator 116. The L-shaped bracket 404 maintains the camera 400 in its undeployed position when the nozzle head 104 is retracted. The second camera 401 is similarly connected to the second arm 114 and second extension arm actuator 118.

The cameras 400 and 401 are placed into a stowed position during deployment of the end effector 102. When the nozzle heads 104 and 106 are in their retracted positions, the L-shaped brackets 404 contact the respective second linkages 406, thereby acting as a stop by preventing the respective springs 403 from pulling the cameras 400 and 401 into their deployed positions. As shown in FIG. 6, as the first extension arm actuator 116 is moved into the extended position, the attached rod follower 405 and L-shaped bracket 404 are displaced in a radially outward direction. Displacement of the L-shaped bracket 404 in a radially outward direction removes this hard stop, allowing the shorter linkage 406 to pivot the camera 400 into its deployed position (shown in FIG. 14). The tension of the spring 403 actuates this motion. Movement of the second extension arm actuator 118 into the extended position similarly deploys camera 401.

In accordance with the present invention, additional cameras may be placed about the steam generator 16 for monitoring the deployment of the end effector 102 and the actual sludge removal process.

A second embodiment for deploying the end effector 102 into the desired portion of the steam generator 16 includes the vertical telescoping device disclosed in U.S. Pat. No. 5,265,129 issued to Brooks et al., entitled "Support Plate Inspection Device", which is hereby incorporated by reference. The end effector 102 may be substituted for the SID's CCD camera by attaching the end effector 102 to the distal end of the telescoping member. The end effector can be passed through the blowdown lane 60 by inserting the horizontal first boom of the SID system through the blowdown lane. Vertical deployment of the end effector 102 to a selected elevation is achieved by uprighting the vertical telescoping member of SID.

As explained above, the SID device does not appear to display a high load-bearing capability and could become inherently unstable as a result of a variety of torques, loads, and moments placed on the telescoping member. However, incorporation of the end effector 102 into the SID deployment device would assist in overcoming these problems. First, because the nozzle heads 104 and 106 are located in diametrically opposing positions, the reaction forces imparted on the SID system by the water jet discharged from the nozzle jets 108 would be lessened. Second, in its operative position the end effector 102 places the extension arm actuators 116 and 118 in the extended position, whereby the end effector 102 is securely situated between U-shaped tubes 50 located on opposing sides of the central untubed region 56. Therefore, the vertical telescoping member of the SID system is less susceptible to bending caused by any eccentricity of the load thereon or by reaction forces imparted on the system.

A third embodiment for deploying the end effector 102 into a selected elevation in the secondary side 42 of the steam generation 16 is herein provided. According to the third embodiment, the end effector 102 is equipped with flotation devices (not shown) positioned on the bottom of the end effector 102. The end effector 102 is inserted into the exposed hand hole 62 and passed through the blowdown lane 60 by means of the deployment system 175, the SID system, or another equivalent means. Water is then flooded into the steam generator. The floating devices equipped on the end effector 102 ascend to an elevation commensurate with the surface water level.

Although the present invention has been described in detail with reference to its presently preferred embodiments, it will be understood by those of ordinary skill in the art that various modifications and improvements to the present invention are believed to be apparent to one skilled in the art. Accordingly, no limitation upon the invention is intended, except as set forth in the appended claims.

What is claimed is:

1. A deployment assembly suitable for deploying a sludge removal assembly into a steam generator to permit the sludge removal assembly to dislodge sludge from an interior of the steam generator, said deployment assembly comprising:

a support rail;

a self-erecting load-bearing chain comprising a plurality of links; and a plurality of hangers for suspending said plurality of links of said chain from said support rail.

2. A deployment assembly according to claim 1, wherein said support rail comprises a straight section and a curved section, and further wherein said straight section comprises a plurality of detachable segments.

3. A deployment assembly according to claim 2, said deployment assembly further comprising a support hook attached to a distal end of said curved section.

4. A deployment assembly according to claim 2, wherein said support hook is spring-loaded to move between a retracted position and an operative position, said support hook being engageable with the steam generator when in the operative position to secure said deployment assembly to the steam generator.

5. A deployment assembly according to claim 1, further comprising a plurality of cylindrical rollers interconnecting said plurality of hangers to said support rail and movable relative to said support rail, said cylindrical rollers being movable relative to said support rail to permit movement of said chain along said support rail.

6. A deployment assembly according to claim 5, wherein a ratio of said links to said hangers is 2:1.

7. A deployment assembly according to claim 6, wherein each of said plurality of hangers engages two of said plurality of cylindrical rollers.

8. A deployment assembly according to claim 7, wherein each of said plurality of links has at least one journal bearing in bearing engagement with said support rail.

9. A deployment assembly according to claim 6, said deployment assembly further comprising a drive mechanism assembly for moving said chain along said support rail.

10. A deployment assembly according to claim 9, wherein said drive mechanism assembly comprises:

a worm rotatable about an axis of rotation;

a rotatable worm gear mounted on a shaft and constructed and arranged to permit said worm to rotate said worm gear about an axis of rotation that is transverse to said axis of rotation of said worm;

at least one sprocket wheel axially mounted on said shaft and having teeth that mate with interstices located between said cylindrical rollers to thereby move said chain along said support rail.

11. A deployment assembly according to claim 10, wherein said drive mechanism assembly is located at the back end of said support rail.

12. A deployment assembly according to claim 10, wherein said drive mechanism assembly further comprises a drive motor for rotating said worm about said axis of rotation of said worm.

13. A sludge removal assembly adapted to be inserted into and dislodge sludge from an interior of a steam generator, said sludge removal assembly comprising:

a deployment assembly comprising a support rail and a self-erecting load-bearing chain;

an end effector assembly comprising a hub, at least first and second arms which, when in an operative position, extend from said hub in diametrically opposite directions so that said first and second arms are substantially coaxially aligned with one another, and a drive mechanism cooperatively associated with said first and second arms to rotate said first and second arms about said hub in a plane transverse to a rotational axis of said hub, at least first and second nozzle heads associated with said first and second arms, respectively, and first and second extension members associated with said first and second arms, respectively; and a connector assembly positioned intermediate said end effector assembly and said chain of said deployment assembly, said connector assembly comprising a first means for rotating said end effector assembly ninety degrees about a longitudinal axis of said end effector assembly, and a second means for pivoting said end effector assembly ninety degrees between a first alignment position in which said longitudinal axis of said end effector assembly is substantially parallel to said chain and a second alignment position in which said longitudinal axis of said end effector assembly is substantially perpendicular to said chain.

14. A sludge removal assembly according to claim 13, wherein:

said support rail has a straight section and a curved section; and said chain comprises a plurality of links.

15. A sludge removal assembly according to claim 14, wherein said deployment assembly further comprises a plurality of hangers for suspending said plurality of links from said support rail.

16. A sludge removal assembly according to claim 5, wherein said deployment assembly further comprises a plurality of cylindrical rollers connecting said plurality of hangers to said support rail and movable relative to said support rail to permit said chain to move along said support rail.

17. A sludge removal assembly according to claim 12, wherein said first means rotates said end effector assembly via cable-actuated rotation about a fixed pulley.

18. A sludge removal assembly according to claim 17, wherein said second means comprises a hydraulic cylinder having an extension rod accommodated therein.

19. A sludge removal assembly according to claim 13, wherein said deployment assembly further comprises a drive mechanism assembly for moving said chain along said support rail.

20. A sludge removal assembly according to claim 13, wherein each of said first extension member and said second extension member is displaceable in a radial direction between a retracted position and an extended position, the retracted position being closer to said hub in the retracted position than the extended position.

21. A sludge removal assembly according to claim 20, wherein said first and extension members are at least partially accommodated within said first arm and said second arm, respectively, when in the retracted position.

22. A sludge removal assembly according to claim 21, wherein each of said first and second nozzle heads has nozzle jets arranged at 0, 60, and 300 degrees with respect to the longitudinal axis of said end effector assembly.

23. A method for removing sludge deposits from a steam generator, comprising the steps of:

providing an end effector assembly configured to be insertable into a steam generator, said end effector assembly comprising a hub, at least first and second arms which, when in an operative position, extend from the hub in diametrically opposite directions so that the first and second arms are substantially coaxially aligned with one another, at least first and second nozzle heads associated with the first and second arms, respectively, said first and second nozzle heads each having at least one water jet attached thereto, and first and second extension members associated with the first and second arms, respectively, the extension members displaceable in the radial direction to move the first and second nozzle heads between a retracted position and a deployed position, the nozzle heads being closer to the hub in the retracted position than in the deployed position;

deploying the end effector assembly into the steam generator;

arranging the first and second extension members to position the first and second nozzle heads in the retracted position;

rotating the first and second arms to position the first and second nozzle heads at a selected rotational position;

displacing the first and second extension member in the radial direction to move the first nozzle head and the second nozzle head into the extended position;

contacting the first and second nozzle heads with exterior surfaces of selected U-shaped tubes of the steam generator;

discharging pressurized fluid through the nozzle jets and thereby dislodging sludge from the interior of the steam generator.

24. A method according to claim 23, wherein said contacting step is followed by a step of arranging the nozzle jets to partially penetrate into interstitial gaps located between the U-shaped tubes of the steam generator.

25. A method according to claim 24, further comprising the additional steps of:

retracting the first and second extension members from the extended position to the retracted position so that neither the first extension member nor the second extension member is in contact with the U-shaped tubes of the steam generator;

rotating the first and second arms to a different selected rotational position; and repeating said displacing step and said contacting step at the different selected rotational position.

26. A method according to claim 24, further comprising the steps of:

retracting the first and second extension members from the extended position to the retracted position so that neither the first extension member nor the second extension member is in contact with the U-shaped tubes of the steam generator;

moving the end effector assembly to a different selected elevation; and repeating said displacing step and said contacting step at the different selected elevation.

27. A sludge removal assembly adapted to dislodge sludge from an interior of a steam generator having a central untubed passageway defined by a collection of U-shaped members, said sludge removal assembly comprising:

an end effector assembly configured to be insertable into a steam generator through an inlet nozzle or substantially comparable-sized entrance of the steam generator, said end effector assembly comprising a hub and at least first and second arms which, when in an operative position, extend from said hub in diametrically opposite directions so that said first and second arms are substantially coaxially aligned with one another, said first and second arms each including a nozzle head having at least one water jet attached thereto adapted to discharge water at a sufficient pressure to dislodge sludge from the interior of the steam generator, wherein at least a portion of said first arm and at least a portion of said second arm are displaceable in a radial direction to move said respective nozzle heads between a retracted position and a deployed position, said nozzle heads being closer to said hub in the retracted position than in the deployed position; and wherein each of said nozzle heads is configured to have a surface that complements portions of exterior surfaces of a plurality of the U-shaped members of the steam generator and is constructed and arranged to engage the U-shaped-members when in the deployed position.

28. A sludge removal assembly according to claim 27, wherein said hub has a rotational axis that is transverse to a radial direction in which said first and second arms extend, and wherein said first and second arms are rotatable about said hub in a plane transverse to the rotational axis of said hub.

29. A sludge removal assembly according to claim 28, wherein said sludge removal assembly further comprises a drive mechanism cooperatively associated with said first and second arms to rotate said first and second arms about said hub in the plane transverse to said rotational axis of said hub.

30. A sludge removal assembly according to claim 29, wherein said drive mechanism is adapted to permit said first and second arms to be discontinuously rotated about said hub in the plane traverse to said rotational axis of said hub and maintained at predetermined rotational positions for fixed amounts of time.

31. A sludge removal assembly according to claim 27, wherein said nozzle head of said first arm is pivotally mounted to said first arm, and further wherein said nozzle head of said second arm is pivotally mounted to said second arm.

32. A sludge removal assembly according to claim 31, wherein said nozzle heads of said first and second arms are arranged in diametrically opposing positions.

33. A sludge removal assembly according to claim 32, wherein each of said nozzle heads has a plurality of nozzle jets, at least some of which are arranged at 0, 60, and 300 degrees with respect to a longitudinal axis of said arm associated therewith.

34. A sludge removal assembly according to claim 27, further comprising an inspection device for viewing the interior of the steam generator when said end effector assembly is fully inserted in the steam generator.

35. A sludge removal assembly according to claim 27, wherein each of said first and second arms of said end effector assembly includes an extension member connected thereto displaceable in the radial direction to move said respective nozzle heads between the retracted position and the deployed position.

36. A sludge removal assembly according to claim 35, wherein said extension members of said first arm and said second arm are at least partially accommodated in said first arm and said second arm, respectively, when said nozzle heads are in the retracted position.

37. A sludge removal assembly according to claim 36, further comprising a pneumatic means for moving said nozzle heads between the retracted position and the deployed position.

38. A sludge removal assembly adapted to be inserted into and dislodge sludge from an interior of a steam generator, said sludge removal assembly comprising:

a deployment assembly comprising a support rail and a self-erecting load-bearing chain;

an end effector assembly configured to be insertable into a steam generator through an inlet nozzle or substantially comparable-sized entrance of the steam generator, said end effector assembly comprising a hub, at least first and second arms which, when in an operative position, extend from said hub in diametrically opposite directions so that said first and second arms are substantially coaxially aligned with one another, and a drive mechanism cooperatively associated with said first and second arms to rotate said first and second arms about said hub in a plane transverse to a rotational axis of said hub, said first and second arms each including a nozzle head having at least one water jet attached thereto adapted to discharge water at a sufficient pressure to dislodge sludge from the interior of the steam generator; and a connector assembly positioned intermediate said end effector assembly and said chain for moving said end effector assembly between a deployment position and an operative position.

* * * * *